US006883296B2

(12) United States Patent
Hartness et al.

(10) Patent No.: US 6,883,296 B2
(45) Date of Patent: Apr. 26, 2005

(54) CASE TAB-LOCK SLITTING AND FLAP SEALER IN COMBINATION WITH A CONTINUOUS RADIAL MOTION CASE PACKING APPARATUS AND METHOD

(75) Inventors: Thomas P. Hartness, Greenville, SC (US); William R. Hartness, III, Greenville, SC (US); Mark W. Davidson, Greer, SC (US); Robert Leslie Dillard, Easley, SC (US); David Lee Scott, Greenville, SC (US)

(73) Assignee: Hartness International, Inc., Greenville, SC (US)

( * ) Notice: Subject to any disclaimer, the term of this patent is extended or adjusted under 35 U.S.C. 154(b) by 58 days.

(21) Appl. No.: 10/637,740

(22) Filed: Aug. 8, 2003

(65) Prior Publication Data

US 2004/0068956 A1 Apr. 15, 2004

Related U.S. Application Data

(63) Continuation-in-part of application No. 10/232,550, filed on Aug. 29, 2002, now Pat. No. 6,722,101, which is a continuation-in-part of application No. 09/418,619, filed on Oct. 15, 1999, now Pat. No. 6,729,103, which is a continuation-in-part of application No. 09/301,394, filed on Apr. 28, 1999, now Pat. No. 6,571,532, which is a continuation-in-part of application No. 09/137,327, filed on Aug. 20, 1998, now abandoned, which is a continuation-in-part of application No. 08/338,026, filed on Nov. 10, 1994, now Pat. No. 5,588,282.

(51) Int. Cl.[7] ..... B65B 43/26; B65B 5/00

(52) U.S. Cl. ..... 53/492; 53/247; 53/534; 53/381.2; 53/382.2; 53/382.3

(58) Field of Search ..... 53/381.1, 381.2, 53/382.1, 382.2, 382.3, 492, 247, 534, 539; 414/411, 412

(56) References Cited

U.S. PATENT DOCUMENTS

| | | | |
|---|---|---|---|
| 1,481,259 | A | 1/1924 | Harrison |
| 1,538,406 | A | 5/1925 | McCarty et al. |
| 1,583,767 | A | 5/1926 | Akins et al. |

(Continued)

FOREIGN PATENT DOCUMENTS

| | | | |
|---|---|---|---|
| DE | 4216721 | A1 | 11/1993 |

*Primary Examiner*—Louis K. Huynh
(74) *Attorney, Agent, or Firm*—McNair Law Firm, P.A.

(57) ABSTRACT

A case packing and case flap separation apparatus is disclosed for packing articles into cases and closing the cases. The cases typically have first and second major and minor flaps interconnected by tab-locks and held in folded positions adjacent vertical ends and sides of the cases. The apparatus includes a conveyor having a radial transport path adapted to transport successive cases through an article insertion section, first and second tab slitting sections, and a case exit section. Tab slitters are associated with the first and second slitting sections adapted to sever the tab-locks so that the major and minor flaps can be separated. First and second flap guides are associated with the first and second slitting section adapted to engage and elevate the separated major flaps away from the vertical walls after the tab-locks have been severed. Preferably, the case packing station and first and second tab slitting sections are located in proximity along the transport path so that the tab-locks are severed while the articles are inserted and gripped in the cases. By gripping the articles with the pickup heads, the articles and their cases can be guided by the pickup heads through the slitting sections as well as weighted down. A pickup head motion converter is operatively connected to the pickup heads to move the pickup heads in a compound motion to effect a first generally linear path at the pickup station for reliable article pick up and a secondary generally linear path at the flap separation station for reliable flap separation.

51 Claims, 34 Drawing Sheets

U.S. PATENT DOCUMENTS

| | | | | | |
|---|---|---|---|---|---|
| 1,958,846 | A | | 5/1934 | Christensen | |
| 2,277,688 | A | | 3/1942 | Cattonar et al. | |
| 2,350,692 | A | | 6/1944 | Milek | |
| 2,730,279 | A | | 1/1956 | Enock | |
| 2,760,316 | A | | 8/1956 | Okulitch et al. | |
| 2,807,125 | A | | 9/1957 | George | |
| 2,860,763 | A | | 11/1958 | Kohrs et al. | |
| 3,012,811 | A | | 12/1961 | Sandrock | |
| 3,327,450 | A | | 6/1967 | Carter | |
| 3,373,543 | A | * | 3/1968 | Nigrelli et al. | 53/381.2 |
| 3,410,050 | A | | 11/1968 | Bell | |
| 3,505,787 | A | | 4/1970 | Tiews | |
| 3,533,214 | A | * | 10/1970 | Standley | 53/381.2 |
| 3,553,927 | A | | 1/1971 | Anglade, Jr. | |
| 3,553,932 | A | | 1/1971 | Rowekamp | |
| 3,555,770 | A | | 1/1971 | Rowekamp | |
| 3,555,773 | A | | 1/1971 | Rowekamp | |
| 3,559,368 | A | * | 2/1971 | Standley et al. | 53/381.2 |
| 3,648,427 | A | | 3/1972 | Raudat et al. | |
| 3,726,061 | A | * | 4/1973 | Pagdin et al. | 53/381.2 |
| 3,727,366 | A | | 4/1973 | Schlueter et al. | |
| 3,780,492 | A | | 12/1973 | Corderoy | |
| 3,805,476 | A | | 4/1974 | Kawamura et al. | |
| 3,971,190 | A | | 7/1976 | McGill | |
| 4,055,943 | A | | 11/1977 | Reichert | |
| 4,215,521 | A | | 8/1980 | Hartness | |
| 4,291,518 | A | * | 9/1981 | Johnson | 53/381.2 |
| 4,293,086 | A | * | 10/1981 | Fincher et al. | 53/381.2 |
| 4,294,057 | A | | 10/1981 | Winiasz | |
| 4,300,330 | A | | 11/1981 | Hartness | |
| 4,446,672 | A | | 5/1984 | Raudat | |
| 4,457,121 | A | | 7/1984 | Johnson et al. | |
| 4,541,524 | A | | 9/1985 | McGill et al. | |
| 4,587,792 | A | | 5/1986 | Hartness et al. | |
| 4,723,649 | A | | 2/1988 | Hartness et al. | |
| 5,054,262 | A | * | 10/1991 | Hertel et al. | 53/382.1 |
| 5,212,930 | A | | 5/1993 | Raudat | |
| 5,257,888 | A | | 11/1993 | Kronseder | |
| 5,313,764 | A | | 5/1994 | Kronseder | |
| 5,375,395 | A | | 12/1994 | Gmeiner | |
| 5,487,257 | A | | 1/1996 | Domeier et al. | |
| 5,501,064 | A | | 3/1996 | Ingram et al. | |
| 5,555,709 | A | | 9/1996 | Savigny et al. | |
| 5,588,282 | A | | 12/1996 | Hartness | |
| 5,797,249 | A | | 8/1998 | Hartness | |
| 6,571,532 | B1 | | 6/2003 | Wiernicki et al. | |

* cited by examiner

CASE TAB-LOCK SLITTING AND FLAP SEALER IN COMBINATION WITH A CONTINUOUS RADIAL MOTION CASE PACKING APPARATUS AND METHOD

BACKGROUND OF THE INVENTION

This is a continuation-in-part application of application Ser. No. 10/232,550, filed on Aug. 29, 2002, now U.S. Pat. No. 6,722,101, which is a continuation-in-part of a application Ser. No. 09/418,619, filed on Oct. 15, 1999, entitled CONTINUOUS CIRCULAR MOTION CASE PACKING AND DEPACKING APPARATUS AND METHOD, now U.S. Pat. No. 6,729,103, which is a continuation-in-part of Ser. No. 09/301,394, filed Apr. 28, 1999, entitled Continuous Motion Case Packing Apparatus And Method, now U.S. Pat. No. 6,571,532, which is a continuation-in-part of application Ser. No. 09/137,327, filed Aug. 20, 1998, entitled Continuous Motion Case Packing Apparatus, now abandoned, which is a continuation-in-part of application Ser. No. 08/338,026, filed on Nov. 10, 1994, entitled Continuous Motion Case Packing Apparatus, which is now U.S. Pat. No. 5,588,282, and the above applications and patent disclosures are incorporated herein by reference.

BACKGROUND OF THE INVENTION

The invention relates to an apparatus and method for transferring articles into cases using continuous motion, and particularly, where the continuous motion is basically circular and at higher transfer speeds with a small footprint in which case flap tab-lock slitting and flap sealing may also be accomplished.

In the art of case packing, large numbers of articles must be grouped and packaged rapidly by an apparatus that will function dependably without damage to the articles processed. Case packing apparatus has been generally categorized as either intermittent case packing or continuous case packing. In intermittent case packing the article flow and/or case flow is interrupted during article pick up and/or release. Most recently, attention has been directed to continuous case packing in order to increase production. However, the continuous case packing has brought increased problems with handling the processed articles without breakage, damage, or interruption.

In the continuous case packing apparatus, articles are grouped together in successive slugs or groups at a pick up position. The slugs are typically picked up at the pick up position by article grippers carried by an orbital handling machine rotating about two vertical axes. The slugs are transferred to a case loading position where the grippers release the slug of articles into a case. The articles can be released either simultaneously or sequentially as the case is conveyed beneath the slug of articles. Apparatus of this type may be either of the "drop packer" type or "placement packer type." In the drop packer type, the articles are allowed to drop at least a small distance into the case after release. In the placement packer type, the drop, if any, is minimal and the articles are essentially placed gently onto the bottom of the case.

Continuous motion machines rotating about a single horizontal axis are shown in U.S. Pat. Nos. 5,375,395, 5,257,888, and 5,313,764 using articulating arms and pickup heads. A set of article grippers is carried on the ends of the articulating arms. However, during the angular descent from the pick up position to the case packing position, both horizontal and vertical accelerations are typically encountered by the articles, which are gripped only at their tops or necks. Intermittent circular machines rotating about a single vertical axis are shown in U.S. Pat. Nos. 3,780,492 and 2,807,125.

Various other case packers, generally of the continuous motion type, using a vertical orbital conveyor are shown in U.S. Pat. Nos. 5,212,930, 4,541,524, and 4,294,057. The first patent shows depositing the articles sequentially and individually, rather than as a group or slug, into partitioned cases without positively gripping the articles. The latter two patents use gripper devices to grip and place the articles. U.S. Pat. No. 4,457,121 discloses a continuous motion bottle packer wherein a plurality of grids are mounted individually on spokes of a vertical wheel so that each grid moves through an article in feed position where groups of articles are fed into the grid without interrupting the forward speed. Angular and horizontal accelerations of the articles and their contents are encountered due to the rotary wheel motion during the transfer which may be detrimental to the article and/or contents.

Continuous case packers are also known in which a horizontal rotary carousel is used to move vertically reciprocating gripper sets in a horizontal plane about two vertical axes. The reciprocating gripper sets pick up a slug of articles at one position and transfer the slug of articles to a second position where the gripper set is lowered to deposit the articles into a case. Typically the pickup and release stations are on opposite sides of the carousel, requiring parallel conveyors on each side. However, the disposition of the rotary carousel in a horizontal plane requires an inconvenient floor layout, which also occupies a large amount of floor space. The parallel conveyor arrangements needed for the in feed and out feed of articles adds to the floor space problem. The path of the gripper sets between the slug pick up position and the case packing position is also typically curved producing angular and acceleration forces on the articles. The curved article transfer path intersects the path of the conveyed case only for a brief interval making timing a factor. In various of the rotary carousel types, it is known to deposit the articles by lowering the articles, already gripped by the gripper set, through resilient fingers that guide the articles into partitioned cases.

Case packers, generally of the intermittent type, are shown in U.S. Pat. Nos. 3,553,932 and 3,505,787 which also discloses using combinations of a lifting head having suction cups and bottle grids having pockets for picking up containers and depositing them into cases. The containers and the cases are conveyed on parallel conveyors rather than in-line conveyors, and the transfer from the pick up position to the case loading position is lateral, or transverse, to the flow of containers and cases. U.S. Pat. No. 2,277,688 discloses another case packer using an arrangement of a gripper set and a bottle guide set to package the containers into a case. These types of case packers are generally non-continuous as compared to the continuous motion in-line transfer case packers described above where neither the flow of articles nor the flow of the cases is interrupted during operation of the packer.

The articles are packed in cases which typically have flaps held flush to the sides of the case by tab-locks so the flaps do not interfere with case conveyance. After the case is packed, it is necessary to slit the tab-locks so the flaps can be folded over the top of the case and sealed. Typically, the packed cases with locked flaps are conveyed from the case packer to a transfer location a distance from the case packer. At the transfer location, the cases are metered onto a main flight chain through a slitting section and a sealing section. The metering conveyor and slitting and sealing sections normally require an additional 50 feet of floor space.

The case flap slitting and sealer mechanisms have been long known in the industry for slitting the tab-locks holding the case flaps to the side of the case. These mechanisms, such as manufactured by Standard Knapp, Inc. of Portland, Conn., comprise an independent mechanism generally formed along a separate conveyor downstream from the case packer. In practice, filled cases are removed from the packing apparatus and delivered in an inclined fashion to the slitting and sealing mechanism. The space required is substantially equal that of the packing apparatus. The equipment and operation cost is also substantially equal that of the packing apparatus.

Accordingly, an object of the invention is to provide a continuous case packing apparatus having a characteristic radial motion with case flap separation and flap closure sections combined with the case packing apparatus and process.

Another object of the invention is to provide a continuous motion apparatus and method which moves in a circular or radial motion to provide high speeds of operation for case packing and flap closure and sealing.

Another object of the invention is to provide a continuous, radial motion case packing apparatus and method which rotates about a single, central axis to provide a small footprint and high-speed operation in which case packing and flap closure are carried out.

Another object of the invention is to provide a continuous, radial motion case packing and flap closure apparatus and method in which groups of articles are picked up at a pickup station and transferred to a case packing and flap separation station where the motion of the pickup heads is converted from a radial motion to a substantially straight-line motion during article pickup to align with the articles and during tab-lock slitting to guide the cases.

Still another object of the invention is to provide a continuous, circular motion case packing and flap closure apparatus and method wherein the articles are picked up by pickup heads rotating in a radial path are inserted into cases transported on a rotating conveyor disposed below the radial path of the pickup heads rotating about the same axis where the flaps are separated and closed prior to exiting the plate.

Still another object of the invention is to provide a case packing and flap closure apparatus and method with a continuous rotary conveyor having a radial transport path for transporting cases through a case delivery station, a case packing and flap closure station, and a case exit section.

Another object of the invention is to provide coordinated case packing, case flap separation by tab-lock slitting and flap sealing during radial transport of the cases.

Yet another object of the invention is to provide a continuous motion apparatus and method in which a revolving conveyor plate moves successive packed cases to tab-lock slitting sections where the flaps of each case are separated from the cases and closed.

Another object of the invention is the provision of a single continuous radial motion apparatus and method which picks up articles arranged into groups using pickup heads rotating continuously in a radial path, deposits the articles into successive cases transported along the same radial path, slits the flap tab-locks for separation, and elevates the case flaps for sealing during travel along the radial path.

SUMMARY OF THE INVENTION

A case packing and case flap closure apparatus is disclosed for picking up groups of articles at a pickup station and packing the articles into cases. The cases have first and second minor and major flaps interconnected in folded positions adjacent end walls and sidewalls of the case by first and second tab-locks. The cases are transported from a case delivery section to a case exit section along a radial transport path. The apparatus includes a frame; and a plurality of reciprocating pickup heads carried by the frame for rotation in a radial path about a single vertical axis, coinciding with the radial transport path, for picking up the articles at the pickup station and placing the articles in the cases. A rotary conveyor rotates with the pickup heads about the single axis and prescribes the radial transport path. The conveyor is adapted to receive and transport successive cases from the case delivery section to the case exit section. A case packing and flap separation station is disposed between the case delivery section and the case exit section along the radial transport path where the articles are inserted and packed into the cases and the major and minor flaps are separated from the case end walls and sidewalls for sealing. The case packing and flap separation station includes a first tab slitting section for severing the first tab-lock to provide separated first minor and major flaps, and a second tab slitting section for severing the second tab-lock to provide separated second minor and major flaps.

The rotary conveyor plate transports the cases through the case packing and flap separation station along the radial transport path whereby cases are continuously packed with articles, tab-locks severed, and case flaps separated for closure while conveyed along the radial transport path about a single axis. Advantageously, a pickup head actuator has a grip position wherein the pickup heads grip the group of articles, and a release position wherein the articles are released from the pickup heads. The pickup heads are maintained in the grip position with the articles inserted in the cases being transported along the radial path through at least one of the tab slitting sections. A motion converter carried by the frame is operatively connected to the pickup heads to cause the pickup heads, in the grip position, to move generally in a straight-line and thereby guide the articles and cases linearly through the tab slitting section. The radial motion converter also causes the pickup heads to move generally in a straight-line path in parallel alignment with the articles as the pickup heads are lowered to engage and pick up the articles at the pickup station. The case packing and flap separation station is arranged along the transport path so that the articles are inserted in the cases when the first and second tab-locks are cut whereby the weight of the articles holds the cases down for reliable tab-lock cutting. Preferably, the first and second slitting sections include an outer guide and an inner guide arranged adjacent inner and outer edges of the rotating conveyor plate to assist in the positioning and guiding of cases along a generally linear path during movement through the first slitting sections.

In another aspect of the invention, a first flap guide is carried along the transport path adapted to engage and raise a separated first major flap after the first tab-lock is cut, and a second flap guide carried along the transport path for engaging and lifting a separated second major flap after being cut. Grid heads having grid fingers are carried for vertical motion with the pickup heads, and include minor flap engaging hooks carried by the grid heads. The grid heads position the engaging hooks beneath the first and second minor flaps on downward movement of the grid heads along the vertical path and during insertion of the articles into the case allowing the engaging hooks to engage beneath the separated minor flaps so that on upward movement of the grid heads along the vertical path, the hooks engage and raise the separated minor flaps.

The first slitting section includes a first slitting mechanism for cutting a first tab-lock to separate a first major flap from a first minor flap; and the second slitting section includes a second slitting mechanism disposed downstream of the first slitting mechanism for cutting a second tab-lock to separate a second major flap from a second minor flap of the case.

A further aspect of the radial motion converter is to effect a secondary rotation and a translation to the pickup heads in order to effect the straight-line path. For this purpose, a plurality of supports carried by the frame, and the pickup heads are slidably carried on the supports whereby the pickup heads swivel on the supports when the secondary rotation is imparted.

According to a method of the invention, a method includes picking up articles, packing the articles into cases having side major flaps and end minor flaps secured to sidewalls and end walls of the case by tab-locks, and separating the flaps from the sidewalls and end walls of the cases to facilitate closing. The method includes continuously rotating a plurality of vertically reciprocating pickup heads in a radial path about a central axis to pick up successive groups of the articles; and continuously transporting a plurality of empty indexed cases about the central axis along a radial transport path. Next, the articles are inserted in the empty cases along a section of the radial transport path to provide packed cases; and at least one of the tab-locks securing the major and minor flaps is severed along a section of the radial transport path after the articles are inserted in the cases. Advantageously, the method includes continuing to grip the articles in the packed cases while transported along the radial transport path with the pickup heads, and severing the tab-lock while the articles are gripped. Further, the method includes causing the pickup heads to move in a generally straight-line while rotating along the radial path to guide the packed cases linearly for severing the tab-lock, and causing the pickup heads to move in a generally straight-line while picking up the successive groups of articles. Preferably, the pickup heads are moved generally in a straight-line by swiveling the pickup heads in a secondary rotation and moving the heads in translation while remaining ones of the plurality of pickup heads are moved only along the radial path. All the tab-locks may be severed while guiding the packed cases linearly using pickup heads gripping the articles and moving in the straight-line. The method includes separating the major and minor flaps from the case sidewalls and end walls, and thereafter closing the flaps over the case for sealing. By transporting the cases on a rotating conveyor and rotating the conveyor about the central axis, and causing successive cases to be indexed on the conveyor plate for rotation through the case deposit section and the tab slitting section while rotating the heads in a corresponding radial path for a fast and efficient operation is provided for case packing and flap closure in a relatively small space.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
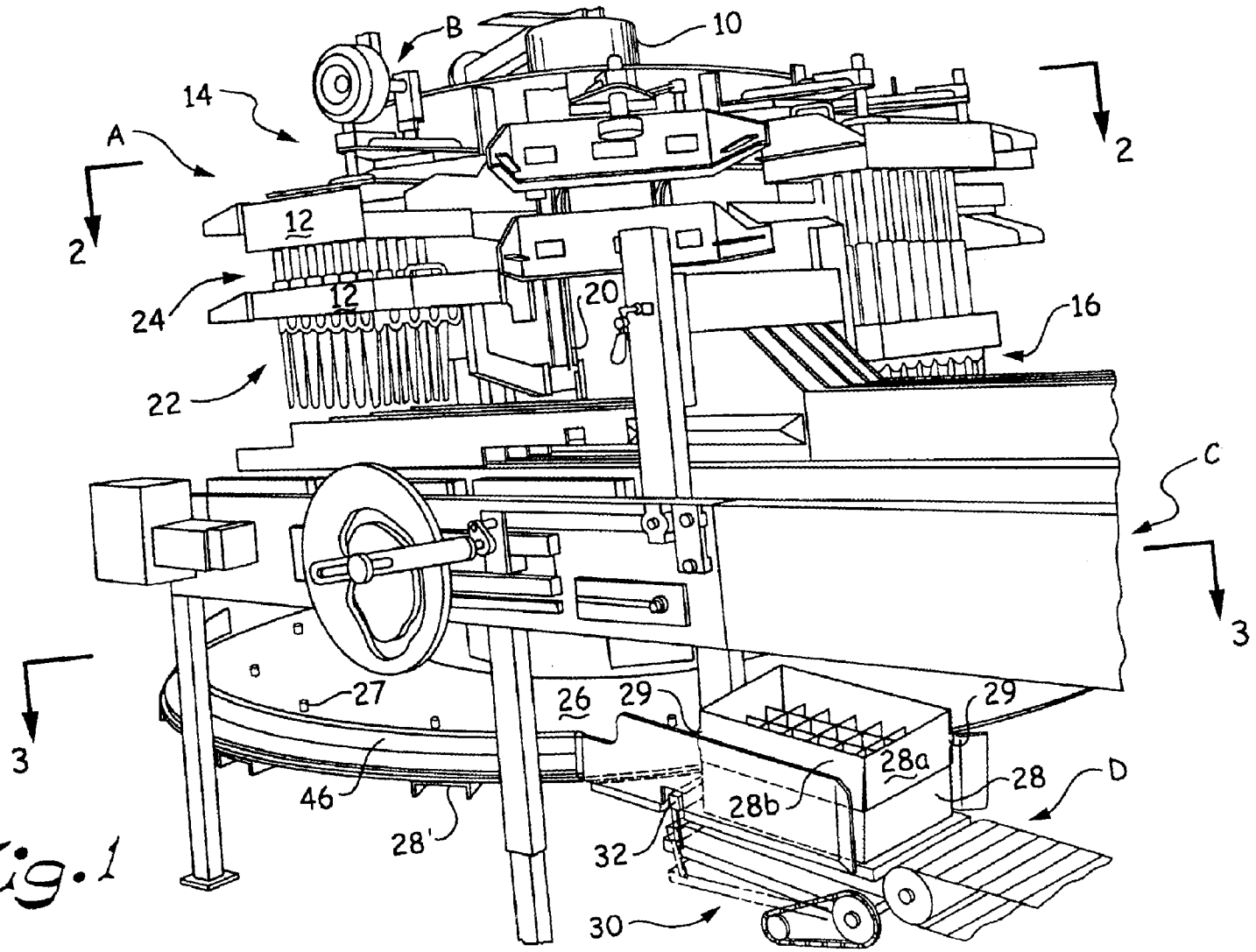
FIG. 1 is a perspective view of a circular, continuous motion case packing, and case flap slitting, and flap sealing apparatus.

Referring now to the drawings, the invention will be described in more detail.

Figure 2:
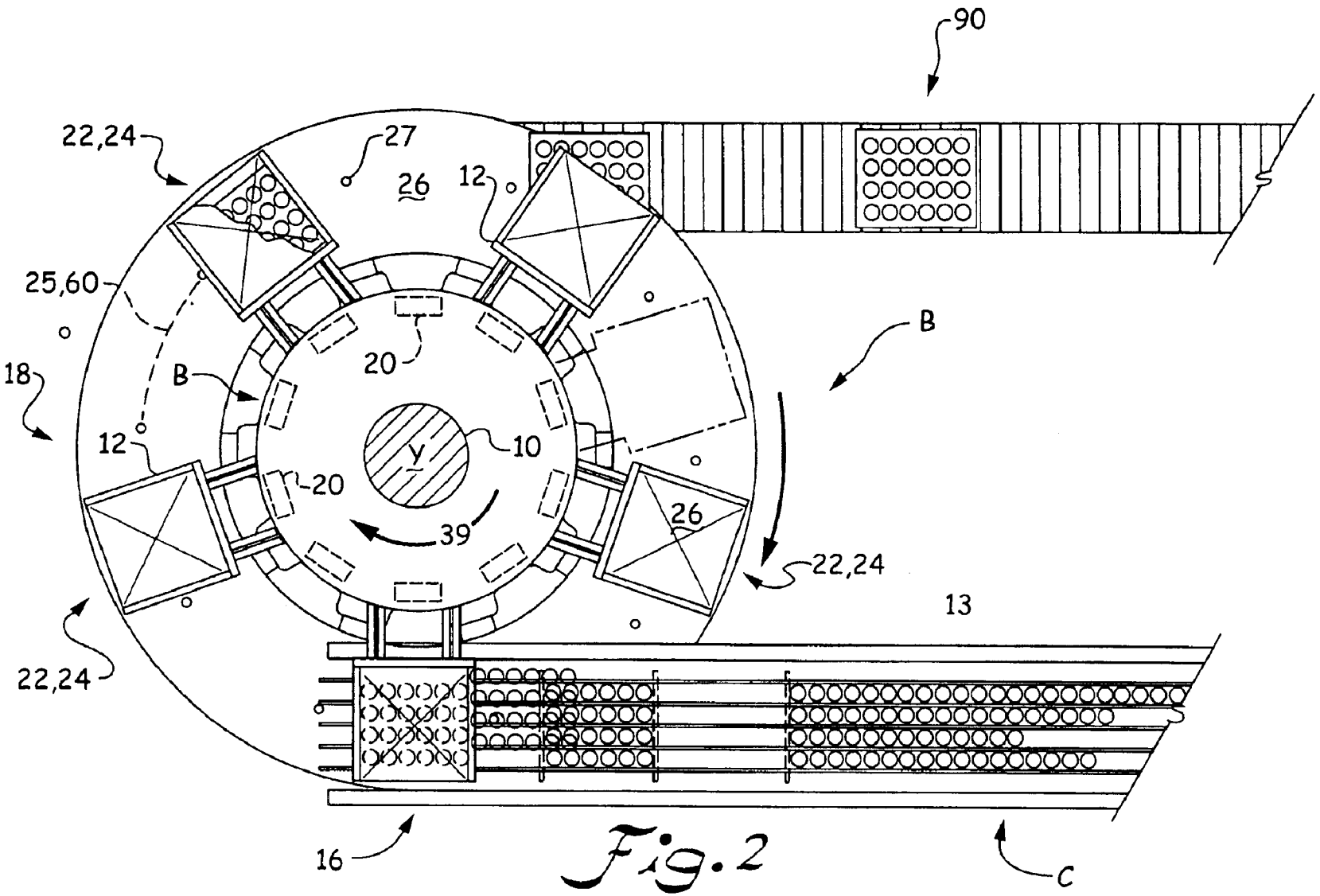
FIG. 2 is a top plan sectional view of the apparatus of FIG. 1 taken generally along line 2—2.
Figure 8A:
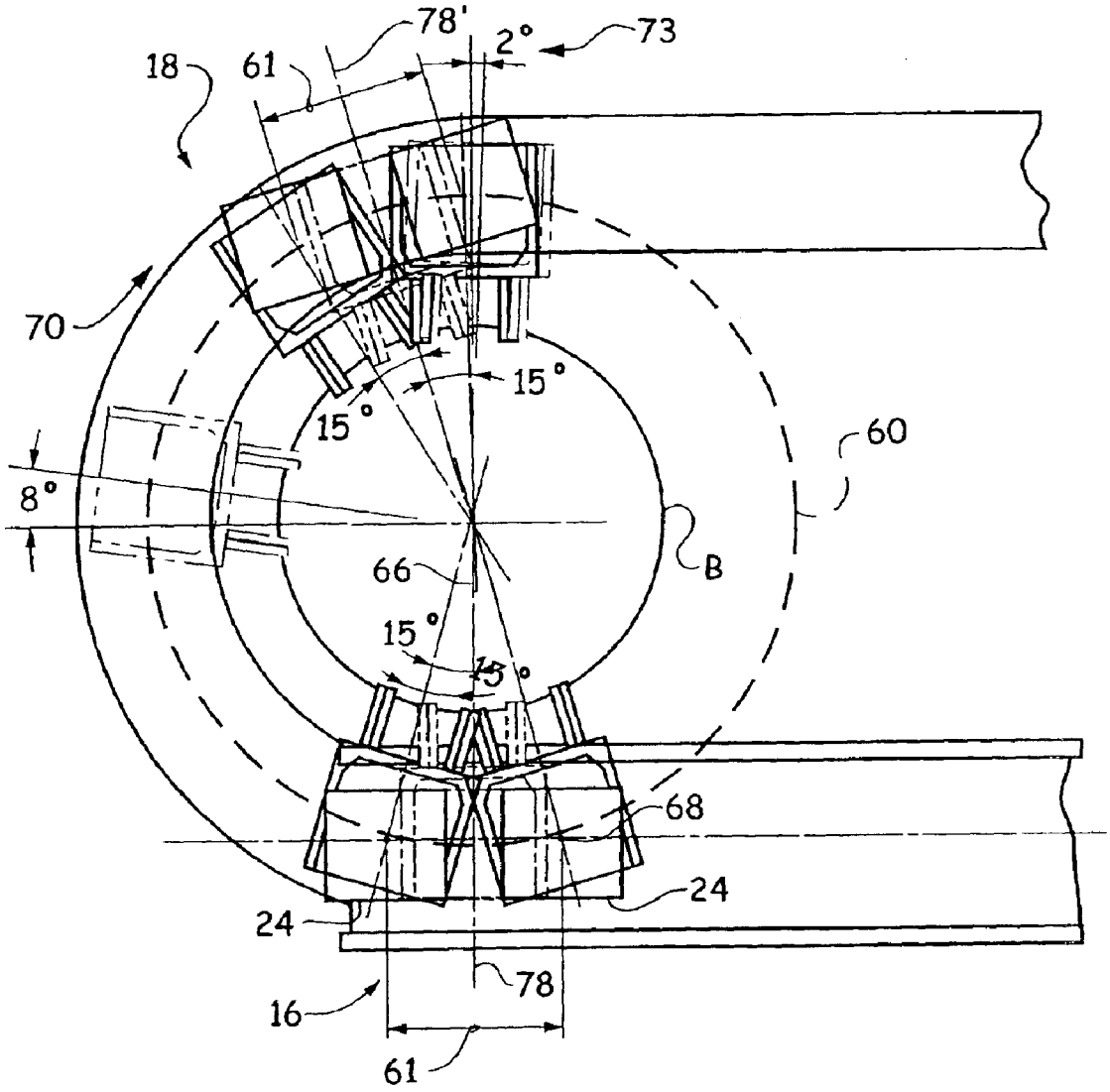
FIG. 8A is a schematic top plain view illustrating a closed cycle path of the pickup and grid heads during the transitory motion wherein their circular motion is compounded to include a straight line motion according to the invention.

As can best be seen in FIGS. 1–3, apparatus and method for packing articles into cases in a simple, continuous circular or radial motion, is illustrated generally as A. The apparatus includes a rotating turret B which rotates about a single, central vertical axis Y, and a stationary central column 10. A plurality of article transfer arms 20 are carried by the rotating turret, as can best be seen in FIGS. 2 and 9. A plurality of reciprocating grid heads 22 and article pick up heads 24, are carried on the transfer arms by way of support frames 12. The pickup and grid heads themselves may be of conventional construction and form no part of the instant invention, and other types of article pickup arrangements may be used with or without the grid heads where applications permit. They, therefore, will not be further described, but reference may be had to the incorporated patents and applications for more detail. FIGS. 1, 2 and 3 illustrate the embodiment of the invention in the form of a case packing apparatus and method in which articles are packed into cases. In the illustrated embodiment, the pickup and grid heads are slidably carried on the transfer arms, and move in a combined vertical, rotating, and straight line motion for picking up the articles at a pickup station 16, designated generally as 16, as can best be seen in FIGS. 8A and 9. The heads rotate in a radial path 60 normally, however, in order to maintain parallel, planar alignment with the group of articles for reliable pick up, the pickup heads are articulated and moved in two degrees of freedom to effect a generally linear or straight-line path 61 during pickup (FIG. 8A).

An article feeder, designated generally as C, is illustrated for conveying articles 13 to pick-up station 16. Article feeder C may be a slug feeder having a metering section, as disclosed in U.S. Pat. No. 5,797,249 ("the '249 patent"), incorporated herein by reference. The slug metering section receives a continuous flow of articles 13 which are conveyed from a laner section. The metering section breaks the articles up into a desired number of articles having a pattern which corresponds to the pattern of the case into which the articles are to be packed. The articles are picked up at pickup station 16 and deposited into empty cases 28 at a case packing and flap separation station, designated generally as 18, which constitutes a case packing station and two flap, tab-lock slitting sections 62, 64 (210, 220). For this purpose, a case indexing conveyor, designated generally as D, is disposed below slug feeder C to provide a continuous flow of indexed cases 28 to case packing station 18 where the articles are generally deposited in the case. Tab-locks 29 connecting the major and minor flaps are slit and the flaps separated from the case sides at this station in preparation for sealing the articles in the case. The case conveyor includes a case delivery section for sequentially moving the cases onto a common support surface 26*a* of rotary conveyor plate 26, and a transport path 25 which, in this case, is radial. Pins 27 on the plate position the indexed cases for movement about turret B with plate 26. Delivery station 30 includes bar 32 which is operated in sequence with turret B to release in timed sequence cases 28 onto plate 26 which, in turn, moves each case to the case packing and tab slitting station. The configuration of the plate is circular. The radial paths of the cases and superposed pickup heads, 25 and 60 respectively, coincide generally.

Figure 9:
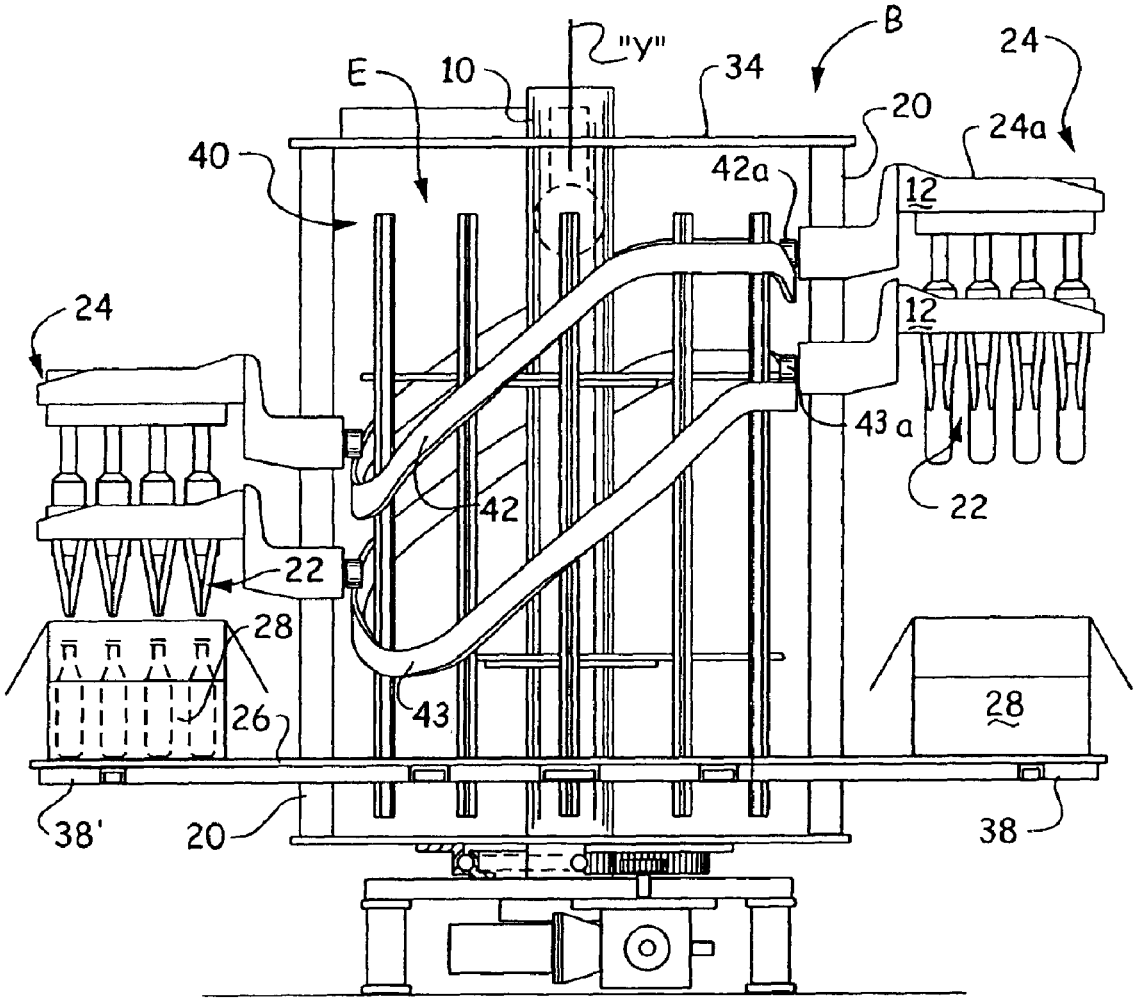
FIG. 9 is a side elevation view illustrating a revolving turret head support frames, and circular cam tracks controlling the vertical head positions.

As can best be seen in FIG. 9, turret B includes a top frame member 34 and bottom frame member 36 between which transfer arms 20 are affixed. Transfer arms 20, in the illustrated form of steel beams, are circumferentially spaced around the frame members to generally define the turret B which rotates in circular direction 39 (FIG. 2). As illustrated, there are ten transfer arms spaced around the turret. The number of arms may vary depending on the application. Turret B is constructed and driven in the manner described in detail in co-pending application Ser. No. 09/418,619 afore referred to. Turret B is rotated clockwise as illustrated. The turret may be also be rotated counter clockwise if the apparatus is designed that way. A gear motor may be utilized to drive case conveyor D through a suitable belt drive arrangement, so that the turret and transfer operation are synchronized with the conveying of indexed cases to be packed and sealed while the turret, and pickup heads, are driven to rotate at a generally constant speed.

Within the interior of turret B, as defined by the turret cage of transfer arms 20, is stationary central column or support 40 supported by the column 10. Affixed to stationary support 40 is a cam support drum having a plurality of vertical braces which are affixed to the stationary support 40 in suitable manner. Central column 10 extends through a clearance hole formed in top and bottom turret plates 34, 36. Circular cams 42, 43 encircle and are affixed to the braces and form part of a vertical position mechanism E that controls the vertical positions of pickup and grid heads 24, 22. The drum braces, cams, intermediate plates, and central column may be affixed together in any suitable manner, such as conventional bolts, to define a stationary structure about which turret B rotates. Other suitable means of reinforcing and securing the operative construction together may be utilized, such as welding and the like, as will be apparent to a mechanic of average skill in the art.

Vertical motion mechanism E for controlling the vertical positions of the pickup heads and grid heads preferably includes circular cams 42 and 43, as can best be seen in FIG. 9. For this purpose, cam rollers 42*a* and 43*a* are carried respectively by support frame 12 which supports pickup and grid heads 24, 22 which ride on cams 42 and 43, respectively. Pickup heads 24 and grid heads 22 slide on transfer arms 20 by means of guide bearings which carries support frame 12 on which pickup and grid heads 22 and 24 are pivotally and slidably carried. Cam rollers 42*a* and 43*a* are secured to the guide bearing carried by support frames 12. In this manner, the vertical positions of the pickup head 24 and grid head 22 are controlled as the cam rollers follow circular cams 42 and 43 to provide the desired operational positioning. In essence, a sequencing and control of the vertical positions of pickup heads 24 and grid heads 22 may be provided like that disclosed in the incorporated '249 patent or co-pending application Ser. No. 09/418,619 in regard to the picking up and releasing steps of operation. In some applications, particularly when packing cases without partitions and cells, grid heads may not be required.

Article Pickup Station

Figure 7A:
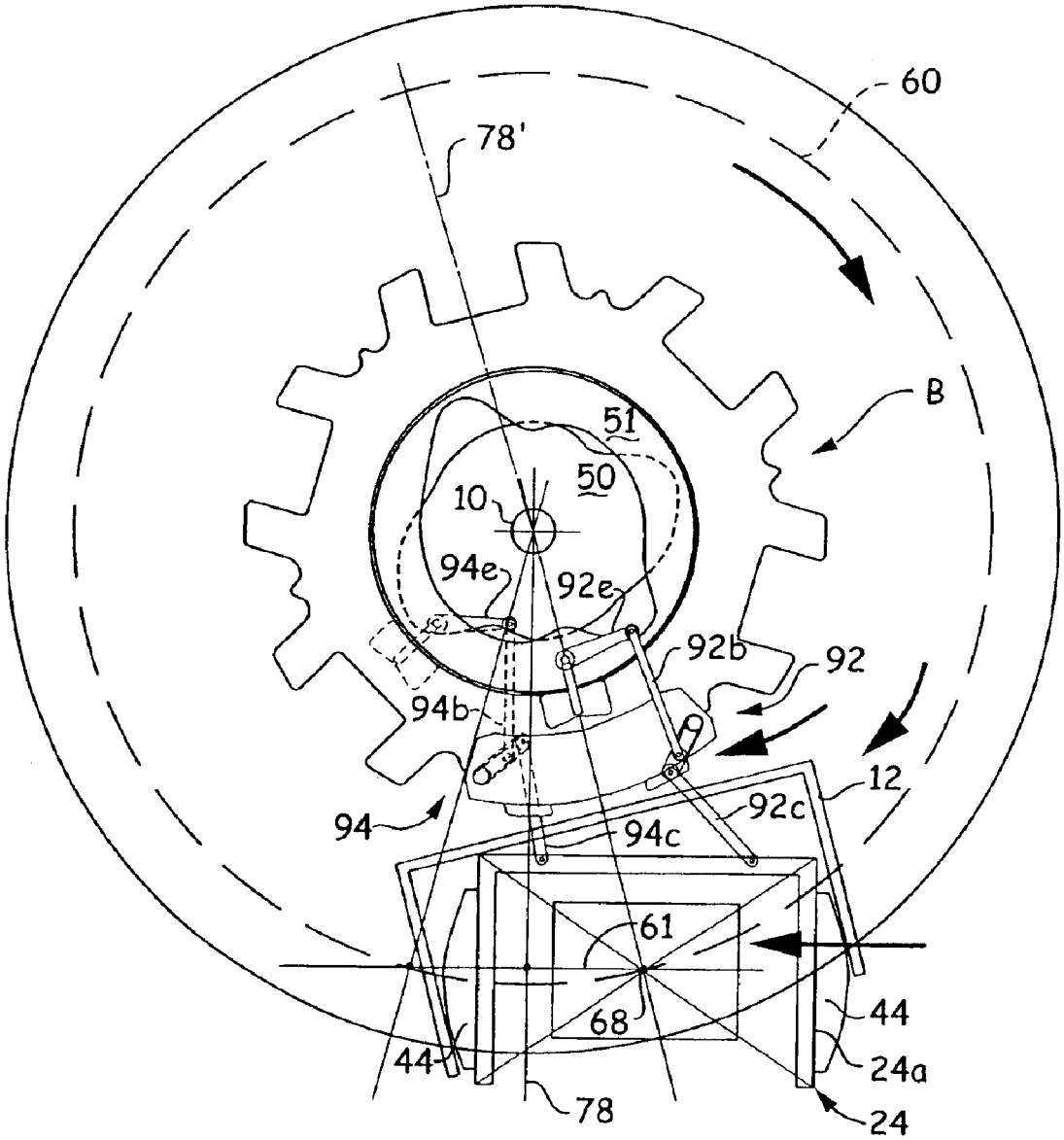
FIG. 7A is a schematic top view illustrating a pre-position of the motions of the pickup and grid heads wherein the heads are caused to move in a compound rotational and translational motion to effect a straight line motion of the heads along an article pickup station, as well as along any other section of the normal radial path of the heads where desired.
Figure 7B:
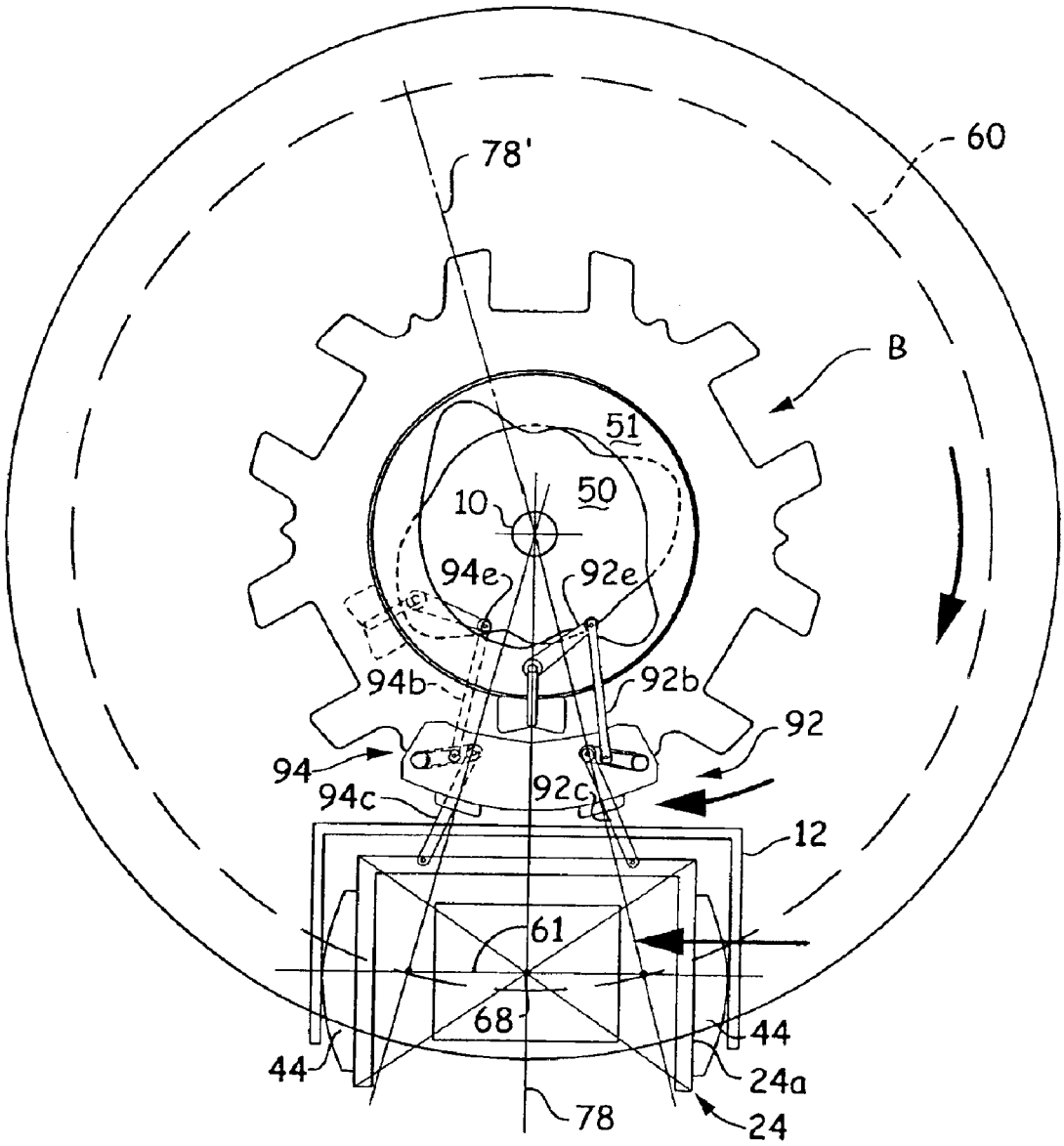
FIG. 7B is similar to FIG. 7A showing the pickup and grid heads in the second and normal position of the compound motion according to the invention.
Figure 7C:
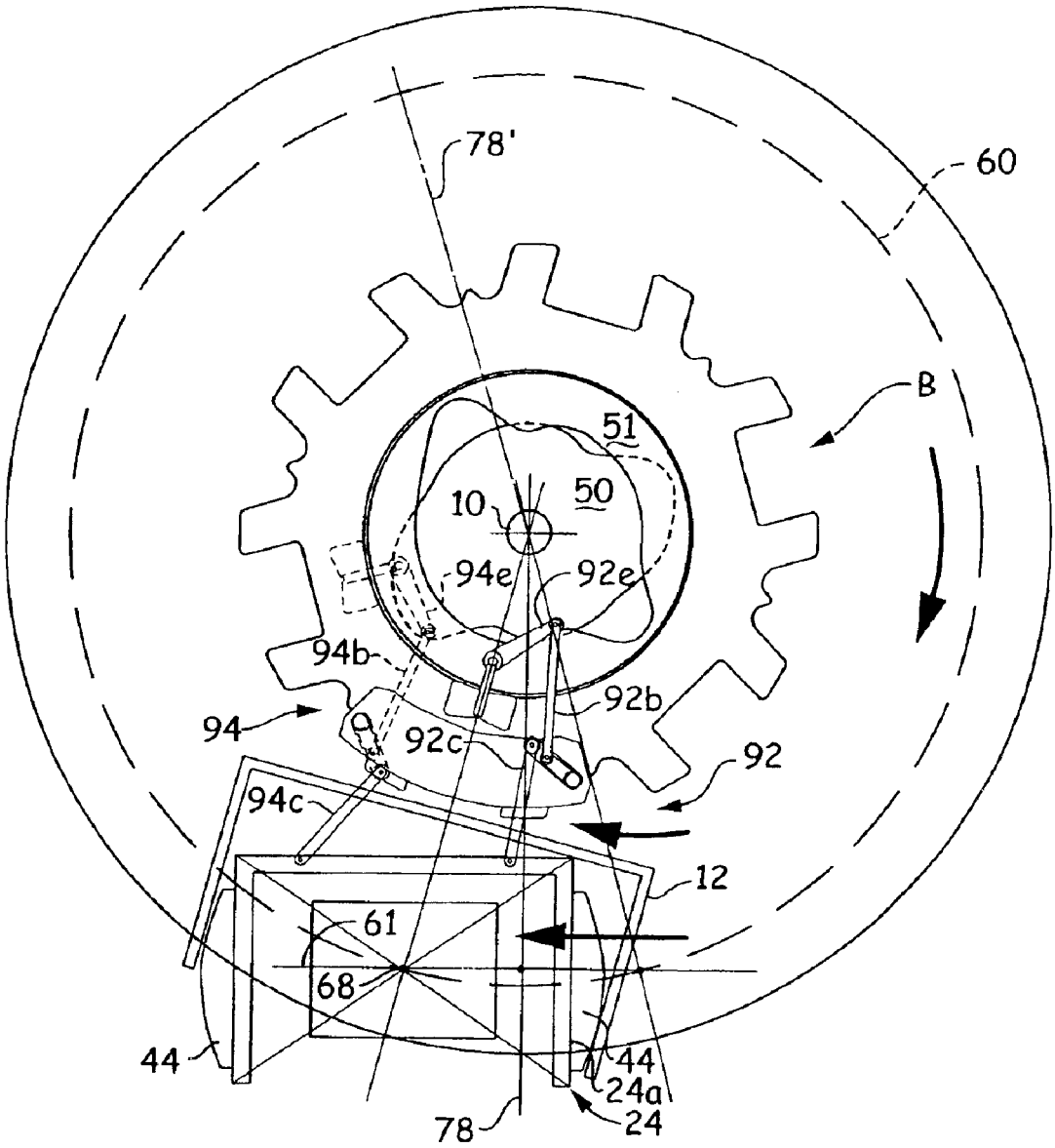
FIG. 7C is similar to FIG. 7A showing the pickup and grid heads in the third and post position of the compound motion.
Figure 8B:
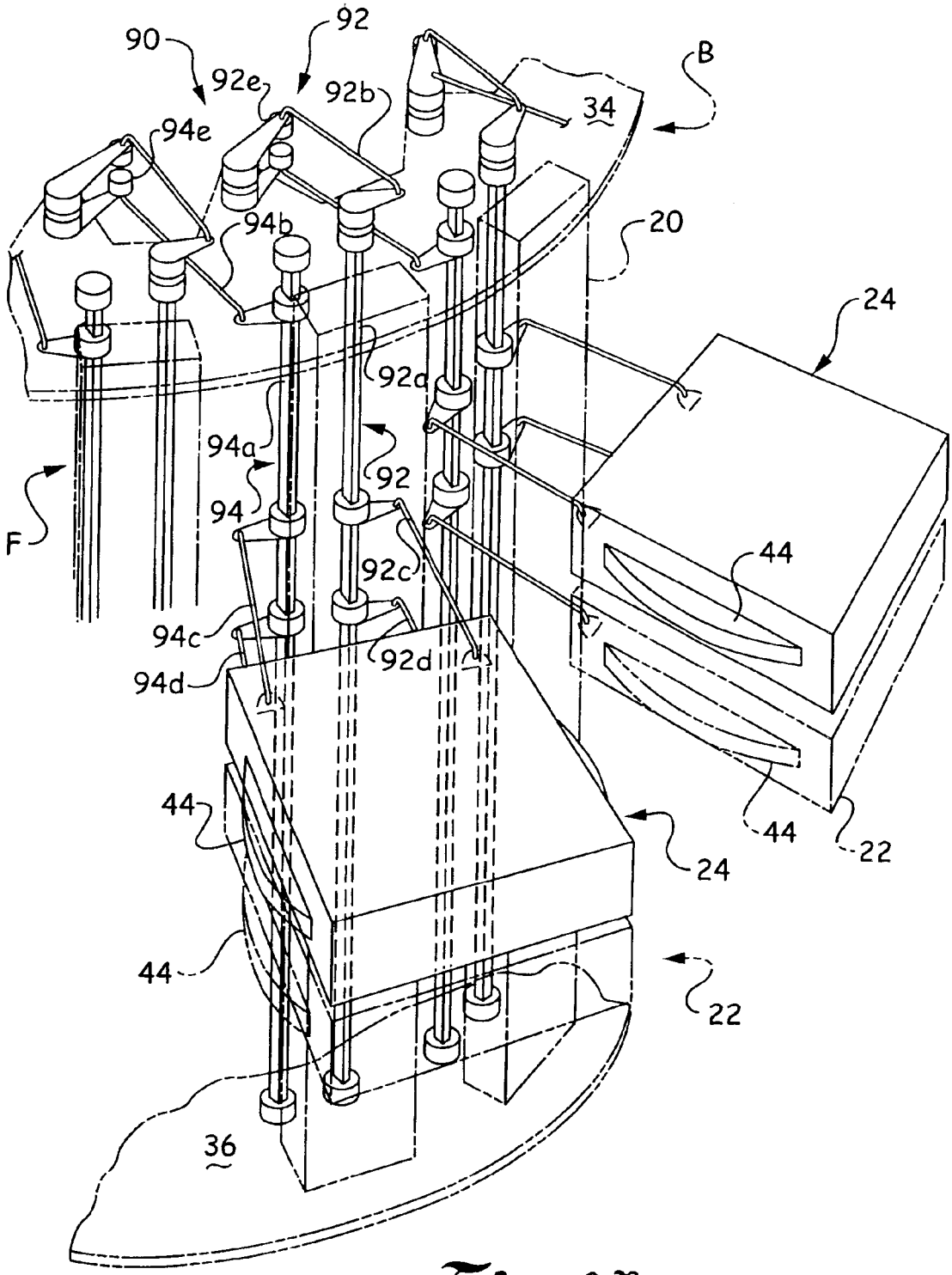
FIG. 8B is a partial perspective view of a motion-converter for unparking the compound motion to the pickup and grid heads resulting in a straight-line motion according to the invention.

As can best be seen in FIGS. 7A, 7B, 7C, 8A, and 8B, pickup heads 24 and grid heads 22 move in a closed cyclic path, designated as 60, as they are rotated by turret B. Along pick-up station 16 the heads move over the articles in parallel, planar alignment with the articles fed by feeder C. At this time, the pickup and grid heads depart from pure radial motion, and move in a compound motion of translation and secondary rotation about axis 68 causing the heads to move in a straight-line path over the pickup section. In this manner, the pickup heads reliably align with and pick up the articles. For this purpose, a pickup head motion-converter mechanism, designated generally as F as best seen in FIGS. 8B, is provided for causing pickup heads 24 and grid heads 22 (or pickup heads 24 alone) to move in the straight-line motion through the pickup section, rather than pure radial motion, while the pickup heads descend and grip the articles for transfer to the case packing and flap separation station. The pick up section 16 is measured over a predetermined arc of rotation of turret B which, in the illustrated embodiment, is an arc of about 30 degrees of turret rotation (FIG. 3B). The 30 degrees includes 15 degrees either side of a radius line 78 perpendicular to a tangent at the pickup station.

Figure 10A:
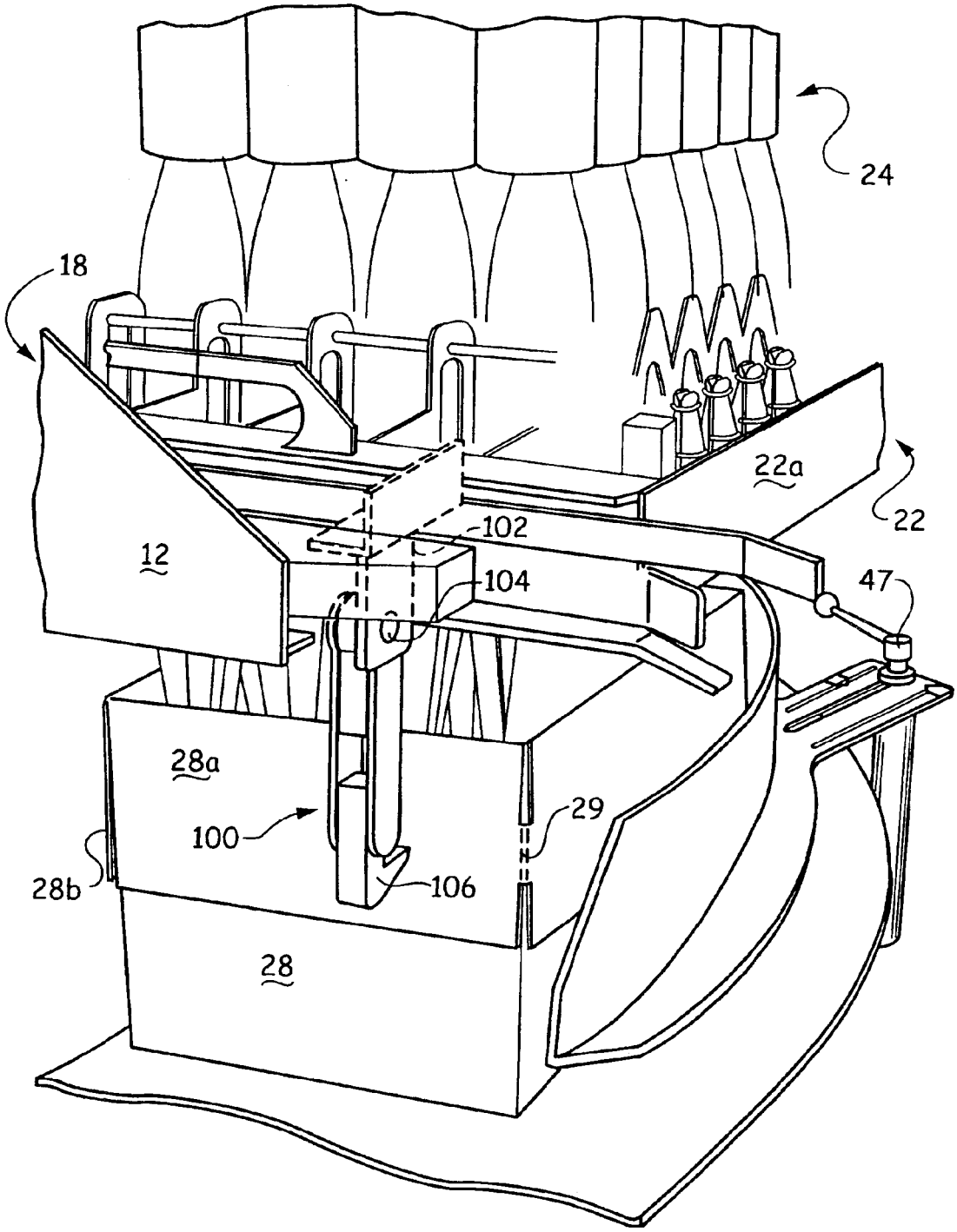
FIG. 10A is a partial perspective view showing a minor flap engaging hook carried by a grid head for movement relative to a case according to the invention.
Figure 10B:
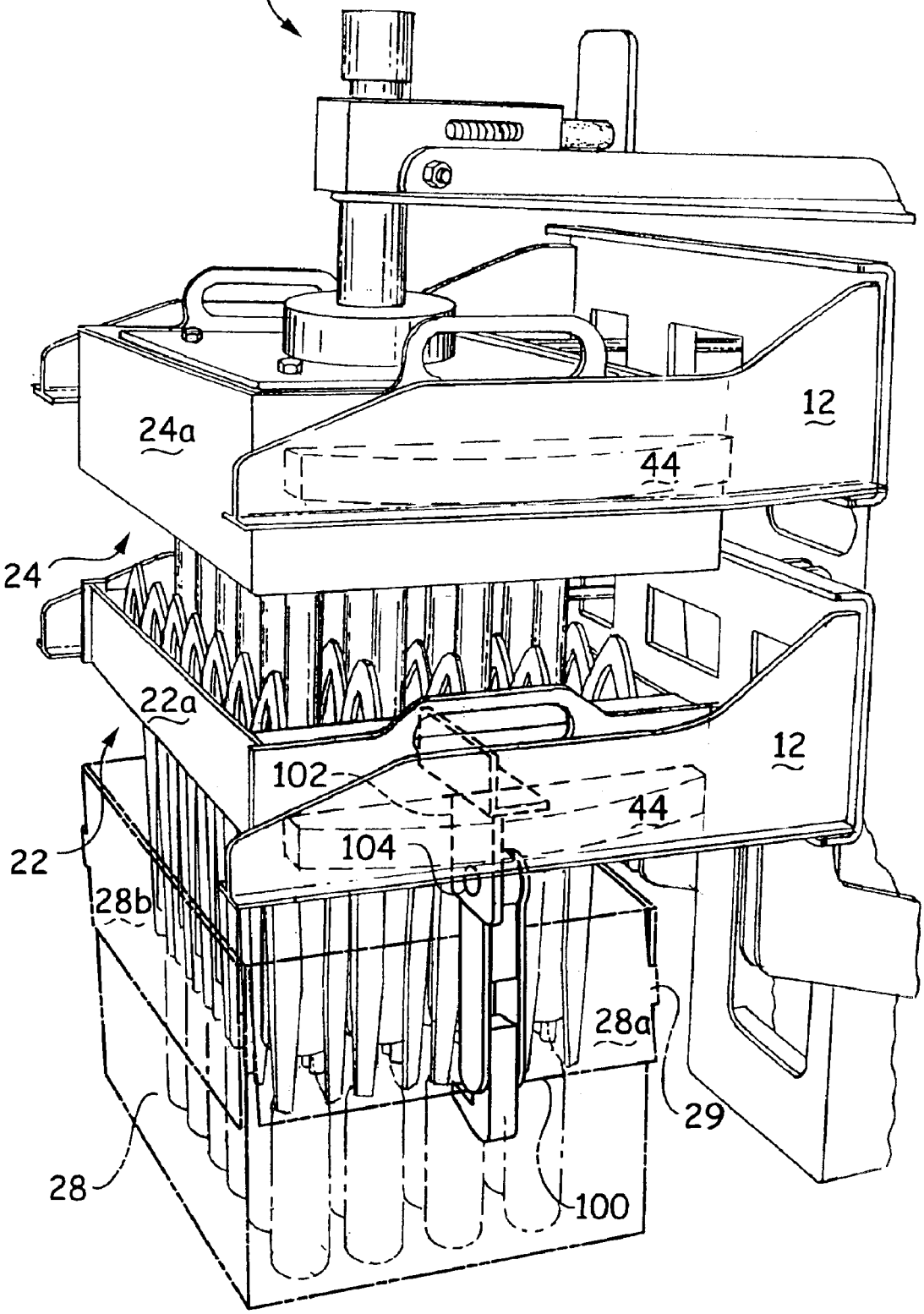
FIG. 10B is similar to FIG. 10A showing the opposite flap engaging hook positioned to raise the opposite minor flap.

The illustrated embodiment of a motion converter F, as can best be seen in FIGS. 7A–C and 8B, will now be described in more detail. First, it is noted that pickup head frame 24*a,* which carries the pickup heads, is slidably carried on a horizontal support frame 12 and moves about an articulated swivel or pivotal axis 68. Grid head frame 22*a* is likewise slidably supported on a grid head support frame 12. Each support frame 12 as seen in FIG. 10B includes a bottom ledge and an upper ledge between which a curved bearing member 44 of head frame 22*a,* 24*a* is sandwiched on both sides of the frame. Preferably curved bearing 44 is constructed of a suitable bearing material such as a high molecular weight plastic. By this means, the pickup and grid heads move in compound motion which includes a secondary rotation or swivel within their respective support frames, and a translation at the pickup station. Thus, in operation, the pickup heads (and grid heads) rotate about turret axis Y along radial path 60 as they are carried by turret B; rotate about a swivel pivot axis 68 and translate during radial motion to provide straight-line path 61 (FIG. 8A). Motion converter F includes a connector mechanism 90, connected between the rotating turret and associated sets of pickup and grid heads to control the compound movement of the pickup and grid heads so they move in a straight-line or linear motion above and in parallel alignment with articles 13 along pickup station 16. As can best be seen in FIG. 8B, connector mechanisms 90 include a first linkage arrangement 92 connected to one side of the pickup head and grid head; and a second linkage arrangement 94 connected to an opposing side of the pickup head and grid head. By this means, the heads are articulated in unison. The linkage arrangements or connecter mechanisms 90 include rotary-motion transfer cam shafts 92*a,* 94*a* which are carried vertically between top and bottom turret plates 34 and 36. Upper arm links 92*b* and 94*b* are received about upper ends of the cam shafts and are secured thereto against rotation. In this manner, actuation of upper arm links 92*b*, 94*b* causes rotation of the cam shafts. First and second lower arm links 92*c*, 94*c*, and 92*d*, 94*d* are slidably carried on cam shaft 92*a* and 94*a*, respectively. First lower arm links 92*c*, 94*c* are secured to opposing sides of pickup heads 24 and second lower arm links 92*d*, 94*d* are connected to grid heads 22. Cam followers 92*e* and 94*e* carried by the upper arm links 92*b*, 94*b* follow a pair of cam plates 50, 51 which are affixed to the top of stationary column 10. The cam followers ride in a cam groove and follow the cam plate to actuate the first and second lower arm links to move the pickup heads and grid heads through a first pre-pickup position shown in FIG. 7A, then to a pickup position shown in FIG. 7B, and then to a post pickup position shown in FIG. 7C whereby the pickup and grid heads move in a straight-line motion 61 along the pick up section 16 for reliable pick up of articles 13. The cam plates 50, 51 may be stationarily mounted on the central support. Basically, the heads are maintained in a straight-line motion in parallel alignment over the articles for a linear distance that corresponds to a predetermined arc of about 30 degrees of turret rotation (FIG. 3B). The pickup heads also are lowered by the vertical motion to engage and grip the articles along the straight-line path. The important aspect is that the grippers of the pickup heads lie in a plane parallel to the plane of the article tops, i.e., parallel alignment to engage the article. Other means of providing the combination motion of the pickup and/or grid heads may also be used other than illustrated mechanism F. For example, use of position sensors and control through an electronic gear motor may be had, or hydraulic control systems, as well as other mechanical arrangements. Motion converter F is described in more detail in co-pending application Ser. No. 09/418,619 which description is incorporated herein.

Referring now to FIGS. 1 and 10B, a pickup head unlatching device 14 is likewise carried by the main frame, whose operation will not be described in detail. The unlatching drive is described in detail in earlier filed co-pending application, Ser. No. 09/418,619 which description is herewith incorporated. In operation, in the deposit position of the deposit and slitting station 18 the unlatching device actuates the gripping members of pickup head 24 to release articles 13 into cases 28.

Turning to FIGS. 1, 3, 9, and 10A, a circular support frame 38 can be seen integral with the rotating turret B adjacent to lower frame member 36. Support frame 38 includes a circumferential shelf in the form of radically extending fingers 38' which extend outwardly to substantially align vertically with support frames 12 and pickup heads 24. Rotating plate 26 is formed with a central opening 26' which is of a size to allow plate 26 to be positioned over column 10 and freely supported by fingers 38'. Plate 26 may be circumferentially adjusted as described in the earlier filed application Ser. No. 10/223,550, which disclosure is incorporated herein. Turning to FIGS. 1 and 3, case conveyor D, which may comprise an endless belt, operates to continuously urge cases 28 to dispensing section 30. Dispensing bar 32 is positioned across the path of the oncoming cases. A control, driven in sequence with the main drive, acts to sequentially pivot bar 32 downward. Each movement releases a case onto guide platform 33 where it is sequentially picked up by plate 26.

Figure 6:
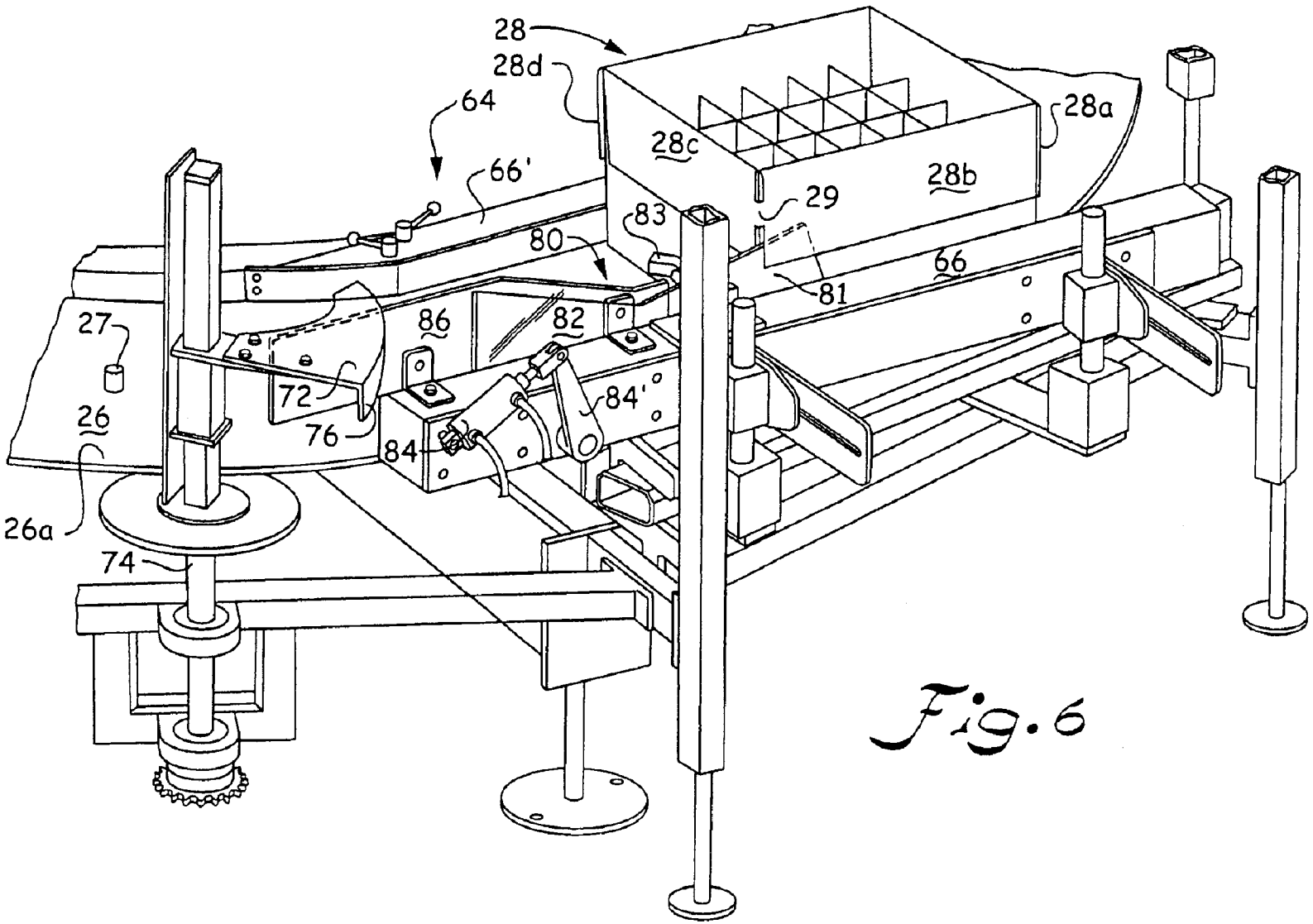
FIG. 6 is a perspective sectional view illustrating the second slitting section relative to the case exit station and illustrating the relative positions of the guide and slitting member initiating the flap separating action.

Each case 28 includes an open top, a bottom, opposed sidewalls and end walls having major flaps, 28*b*, 28*d* and minor flaps 28*a*, 28*c* attached to their respective upper edge (FIG. 6). Each case also may be sectioned into individual compartments. The flaps are in a folded down position and in engagement with the vertical walls. Tab-locks 29 located at opposed, diagonal corners of case 28 retain the flaps in the folded position. The tab-locks must be cut or severed to allow the flaps to be separated and closed to seal the case with tape, etc.

Case Packing and Flap Separation Station

Figure 3A:
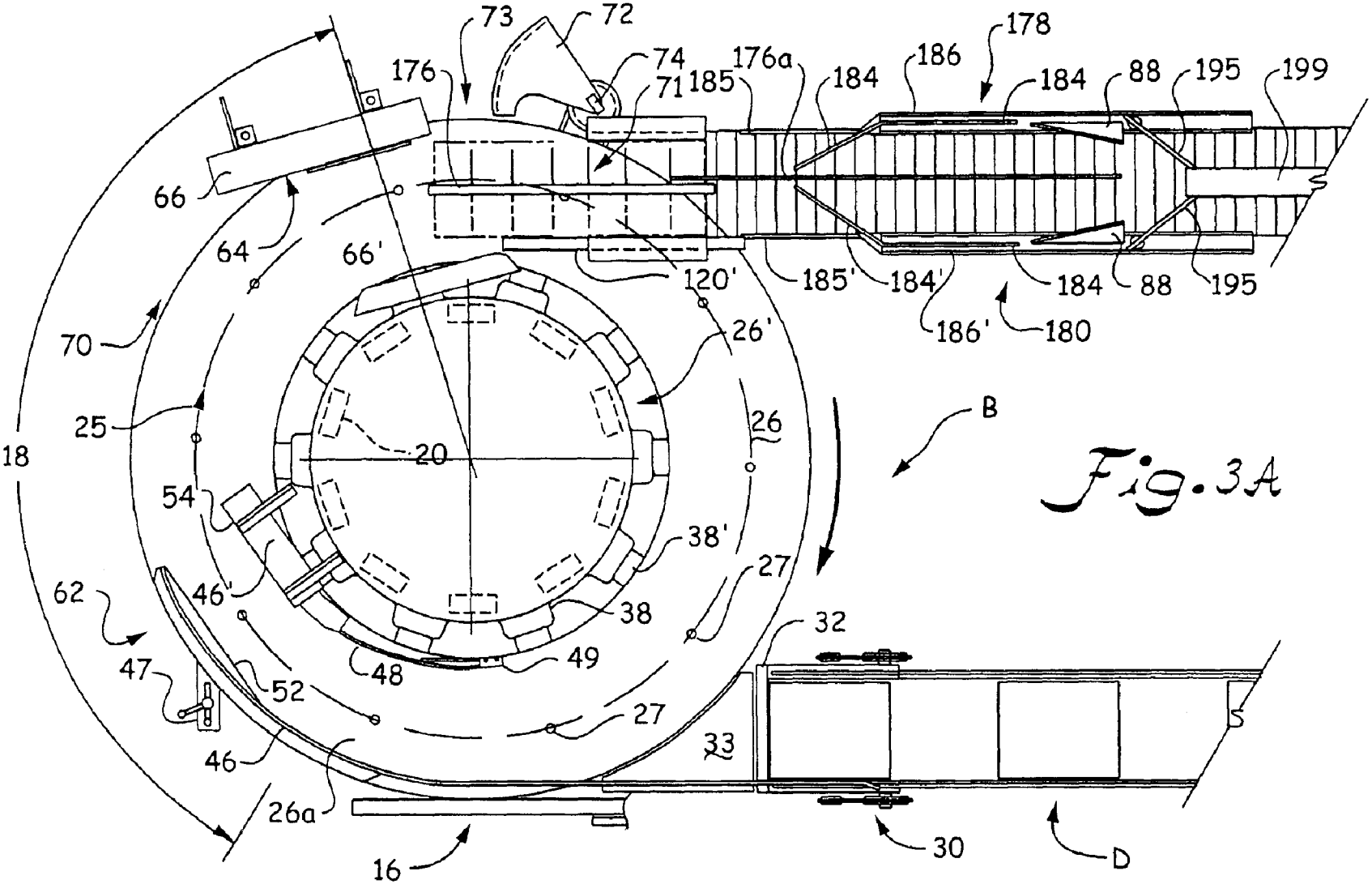
FIG. 3A is a top plan sectional view similar to FIG. 2 illustrating one embodiment of a case packing and tab-lock slitting station according to the invention.
Figure 3B:
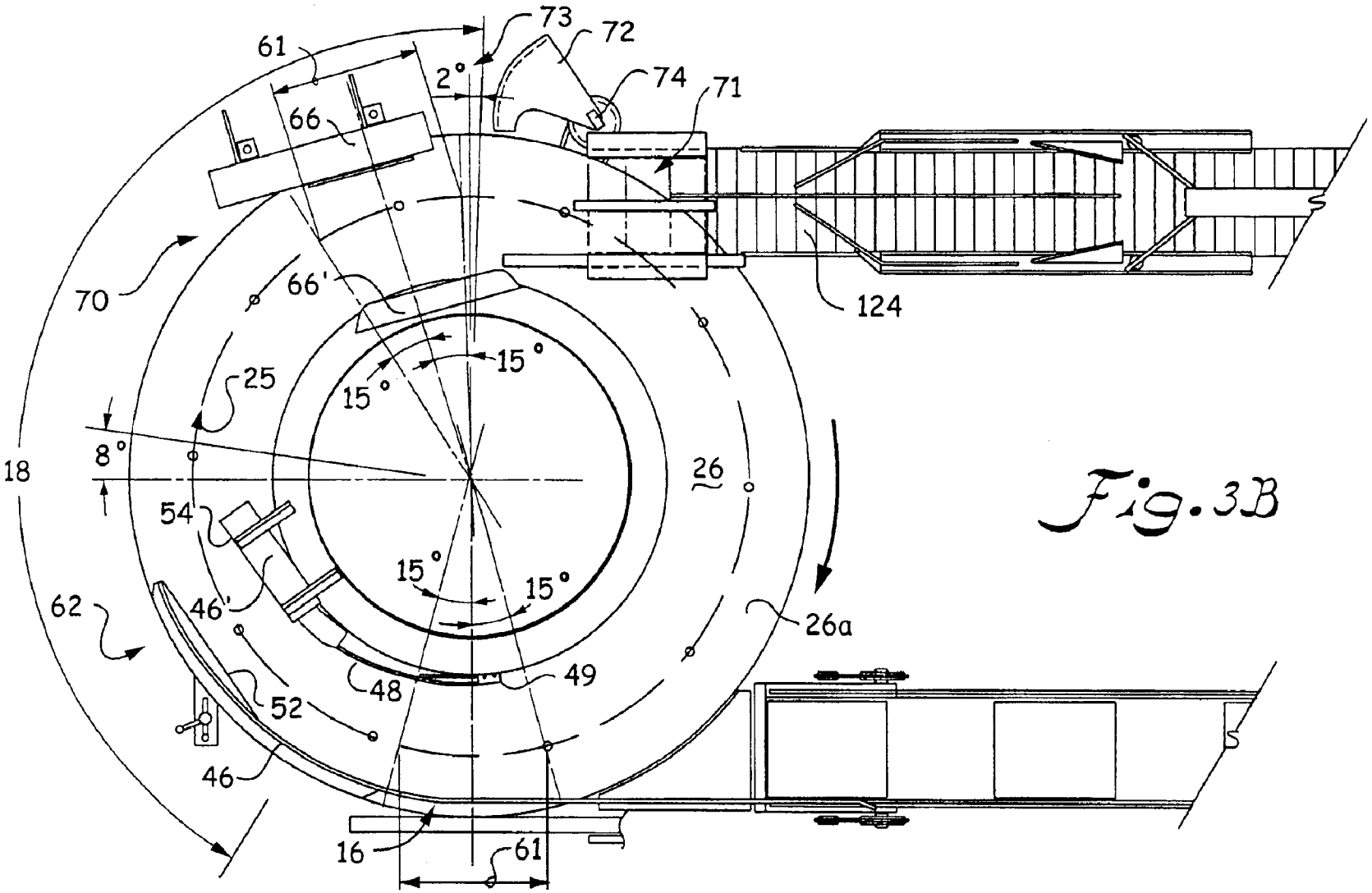
FIG. 3B is a simplified top plan view of FIG. 3A with arcuate process sections illustrated in degrees of rotation for exemplary purposes only.

As can best be seen in FIGS. 3A and 3B, case packing and flap separation station 18 is arranged about radial transport path 25. The case packing and flap separation station includes an article insertion section generally indicated at 70, a first tab-lock slitting section 62, and a second tab-lock slitting section 64. The case packing station ends at a pickup release section 73 where the pickup heads are actuated to release the articles. The pickup head gripper tubes are pulled through the grid fingers. The grid fingers are removed from the cases over the 2° arc indicated. While the case packing station and tab slitting sections are broadly described as being encompassed in the same area for purposes of illustrating a preferred embodiment. However, it is to be understood that the sections may also be thought of as separate from the case packing station, as long as the functional relationships are satisfied as set forth hereinafter.

An example of how the various processing stations may be located about the radial transport path of the conveyor and the radial path of the rotating pickup and grip heads is shown in FIG. 3B. In FIG. 3B a first straight-line path 61 of the heads occurs over a 30° arc at pickup station 16. Case packing and flap separation occurs next, indicated generally at 18, beginning with first tab-lock slitting section 62. Next, the articles are lowered into the cases at article insertion section 70 which includes an 8° arc over which the grid fingers 22 are inserted prior to the articles. A second straight line path 61 of the pickup heads, still gripping the article, occurs over a 30° arc (±15) to guide the cases through second tab-lock slitting section 64. The pickup heads and then the grid heads are taken out of the case over the 2° arc at 73 creating a packed case. The packed case exits conveyor 26 at case exit section 71.

Figure 4:
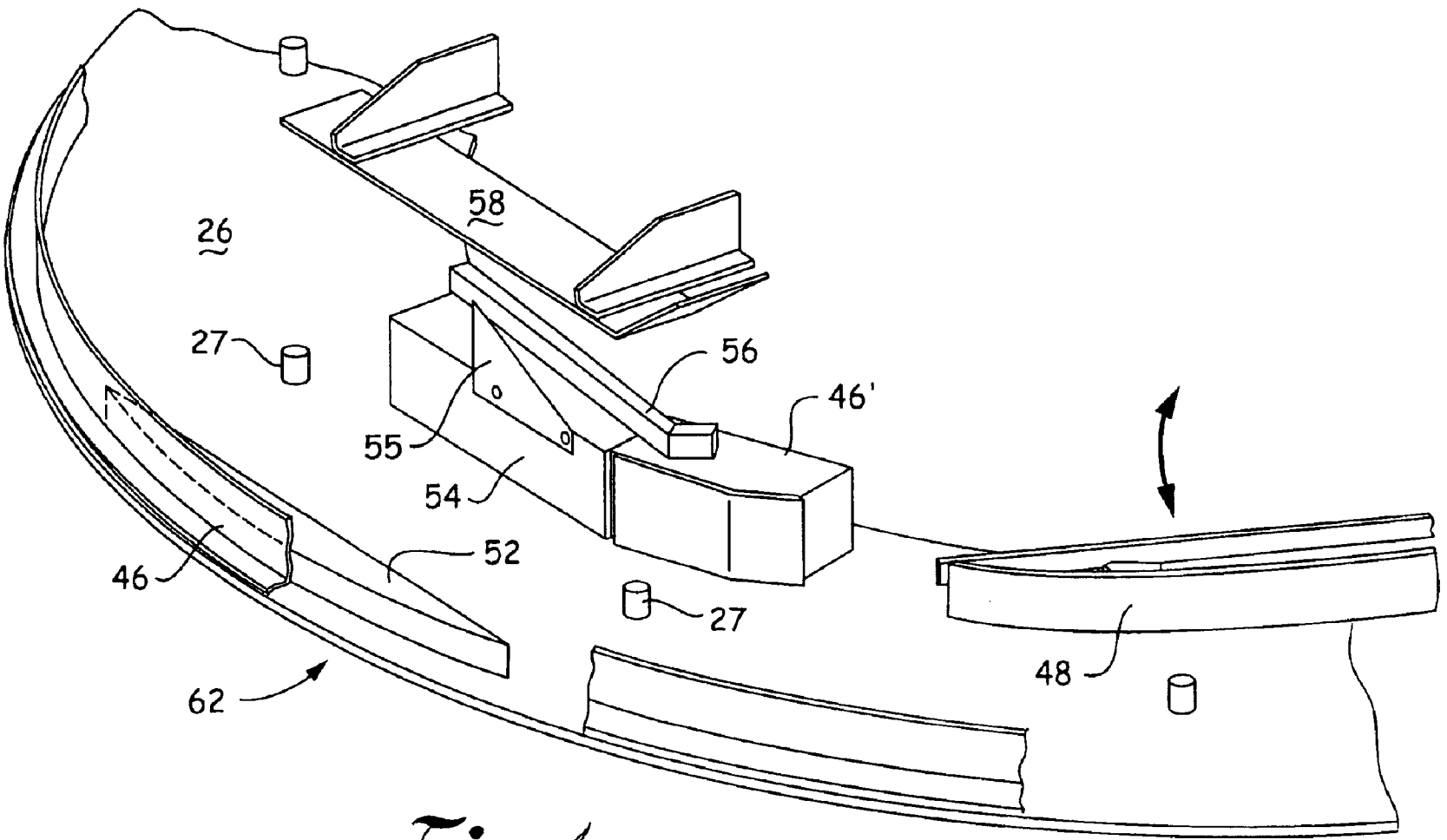
FIG. 4 is a perspective sectional view showing a first slitting section of the case packing and tab-lock slitting section.
Figure 5:
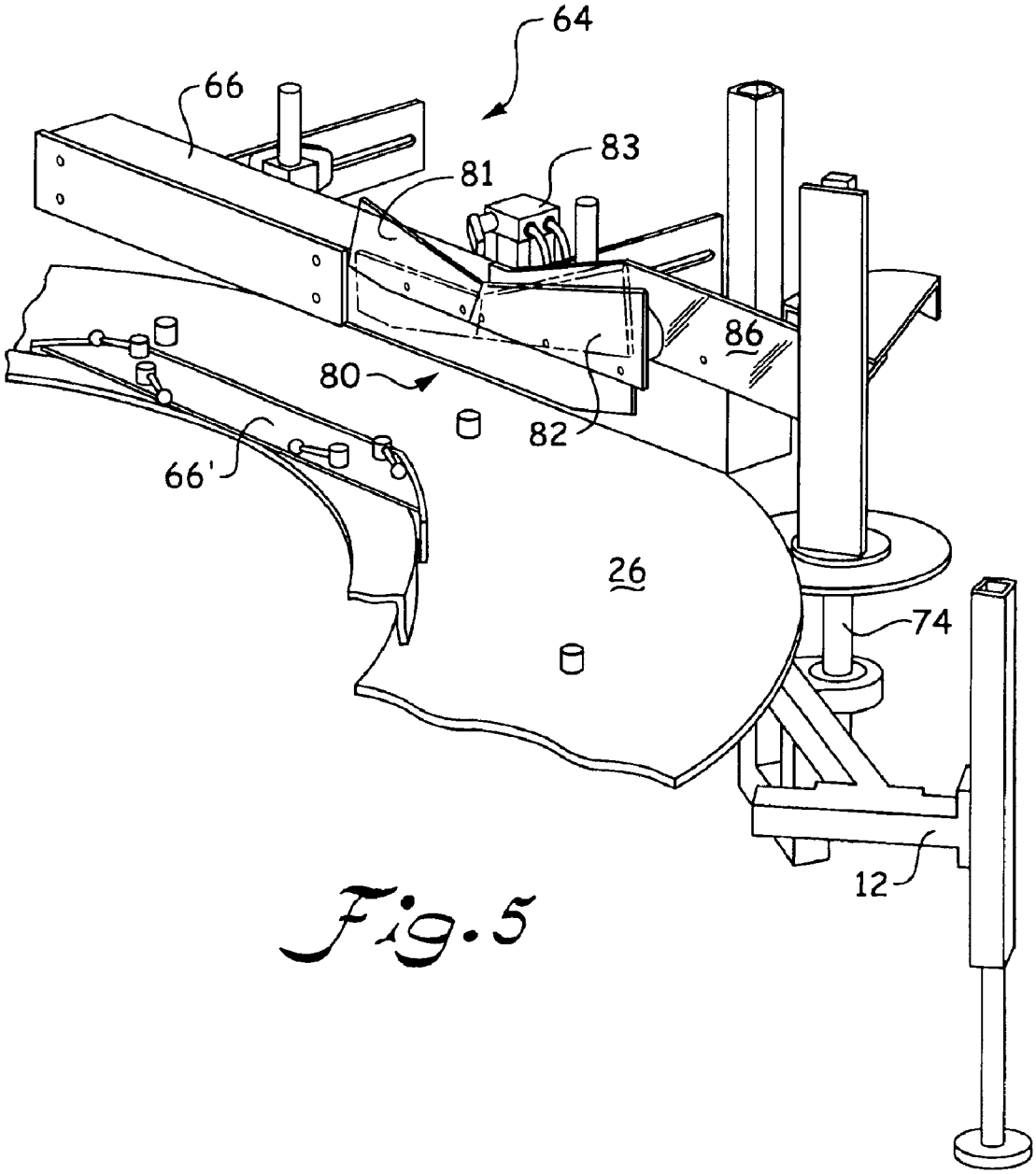
FIG. 5 is a perspective sectional view showing a second slitting section of the case packing and tab-lock slitting station.

Turning now to FIGS. 3, 4, 5 inner and outer guide rails 46, 46' are seen arranged above and adjacent the outer and inner peripheries of plate 26 at first tab-lock slitting section 62. An inner guide member 48 is pivoted at its forward end 49 and is generally urged outwardly. This allows guide member 48 to always be in contact with a case 28 coming onto plate 26 and to urge each case against outer rail 46. Outer guide rail 46 is held in position at one end with intermediate platform 33 and adjacent its opposite end is held by adjustable mount 47 secured with the support frame.

Outer guide rail 46 includes a wedge 52 forming a linear boundary along its inner surface. Inner guide rail 46' includes a forward extension 54 which is secured in position with its inner face disposed parallel with the inner face of wedge 52. Secured along the inner face of extension 54 of the inner guide rail is a knife 55. An inner flap guide 56 is secured with the top of inner guide rail 46' and extends upwardly to a point beyond blade 55. Positioned above and slightly inwardly of inner guide rail 46' is upper guide plate 58 for holding the empty cases down during tab-lock slitting. Upper guide plate 58 is also adjustably mounted with the frame. In operation, the case 28 is moved onto rotary conveyor plate 26, engaged by pin 27 and positively moved in a circular path about axis Y. Upon approaching slitting section 62, inner and outer guide rails 46, 46' position the case to move rotatably with plate 26 and along a linear path aided by inner and outer guide rails 46, 46'. The linear movement allows knife 55 to slide along the outer vertical wall of case 28 beneath the outer major flap and in position to cut rear tab-lock 29 as the case passes by (FIG. 4).

A second tab slitting section 64 is located down stream of the first slitting section 62 as can best be seen in FIGS. 3, 5, and 6. The second tab slitting section includes an inner linear guide rail 66' and an outer linear guide rail 66, each adjustably mounted with the frame in any known manner. Inner guide 66' is arranged over the inner edge of plate 26 and includes a linear inner face. Outer guide rail 66 is located over the outer edge of plate 26 also presenting a linear inner face parallel with the inner face of the inner guide rail. Article insertion section 70 is located before second slitting section 64 so that inserted articles weigh the case for effective tab cutting. Adjacent the exit end of outer guide rail 66 is mounted blade 80. Blade 80 is pivoted to outer guide rail 66 at substantially its center and diverges outwardly and upwardly from that point forming on its upstream side to provide a flap separating blade 81 and, on its opposite side, a tab-lock slitter having a blade 82. A sensor 83 is positioned along the upper edge of outer guide rail 66. Sensor 83 is operative to actuate a drive including piston 84, lever 84' in dependence of the position of an oncoming case 28. The normal position of slitter blade 81 is in the raised position. As case 28 is moved past first slitting section 62 and into second slitting section 64 its outer walls are engaged by inner and outer guide rails 66, 66' which as with guide rails 46, 46' cause the case to move along a linear path while passing through the second slitting section. In addition, as pointed out below the case can be guided during tab-lock slitting at section 64 by the pickup heads moving in a linear path by the compound movement of the pickup heads and thereby the gripped inserted articles and the case. Since the pickup heads are indirectly connected to the case by the articles still gripped by the pickup heads, the cases are guided in the same linear path as the pickup heads during tab slitting. Moving the cases generally in a linear path assists in positioning the ends of separating blade 81 and slitter blade 82 to slide along the outer wall and beneath outer major flap 28*b* during movement of the case through the second slitting section (FIG. 6). As the separating blade moves between the vertical wall and the major flap, the flap is pushed away from the wall and elevated slightly. In the appropriate position sensor 83 actuates drive 84 rotating blade 80 to elevate slitting blade 82 which in turn cuts tab 29 freeing the outer major flap 28*b* from the minor flap 28*a*. The case, weighted with articles, is held in place for cutting. As the case continues through the second slitting section, guide rail 86 moves beneath the major flap to maintain the major flap away from the vertical wall of the case. In the event of a change in article and case size, guide rails 66, 66' are adjusted, adjusting the radial position of the cases at the article release station relative to pickup and grid heads 22, 24. Heads 22, 24 are exchanged to accommodate the selected size, either smaller or larger. Pins 27 of plate 26 are circumferentially adjusted by a ratchet and rail assembly to properly locate the newly sized case relative to the re-sized heads. This operation is more fully described in the earlier filed U.S. application Ser. No. 10/223,550 incorporated herein.

The device thus far described operates in the following manner. Articles 13 are fed to the pickup station 16 and grouped into a slug of articles. Empty cases are moved to the case dispensing section 30 by conveyor D and are retained there by bar 32. Turret B rotates about axis Y carrying heads 22, 24 and plate 26 through pickup station 16, and case packing and flap separation station 18. The heads are carried on main radial path 60 and simultaneously with this main motion through a compound motion of secondary rotation about swivel axis 68 and translation which creates a linear path 61 for the heads through at least a portion of both the pickup station and the case packing and flap separation station.

As the pickup and grid heads move through the pickup station the pickup heads are controlled to pick up a slug of articles. In sequence with this action, bar 32 releases a case onto plate 26 in vertical alignment with heads 22, 24. Cases 28 are controlled to move along a linear path through the second slitting section 64, and pickup and grid heads 22, 24 are controlled to move in a similar linear path resulting from the compound motion about secondary swivel axis 68, as earlier described, to move in a straight line 61 at second slitting section 64. For this purpose, the earlier described motion converter F, best seen in FIGS. 7A–C and 8B and including cam plates 50, 51 and articulating connector mechanism 90 operates to control pickup and grid heads 22, 24 to move in the range of positions as shown in FIGS. 7A–C at slitting section 64. At article insertion section 70 the articles are inserted into cases 28 by vertical downward movement of heads 22, 24 positioning the slug of articles within case 28. The packed case then proceeds to second tab-lock slitting section 64 with the pickup head still down and gripping the articles (FIG. 10B).

As can best be seen in FIG. 10A, one embodiment of an assembly to raise and close the flaps after tab slitting will be described. Attached on opposite ends of grid head 22 are pivotal minor flap raising members in the form of an engaging hook 100. Hooks 100 are pivotally mounted with extension 102 which are secured with frame 12. Pivotal mount 104, which is spring biased to continuously urge hooks 100 inward or toward the vertical the end walls of case 28, connects hook 100 with extension 102. A cam 106 is formed on the lower end of each hook 100. In operation, as pickup and grid heads 22, 24 are lowered into case 28 to deposit the articles in the case compartments, hooks 100 are inwardly urged into a position in which cams 106 overlie the upper edges of the vertical end walls. As the downward movement continues the cams engage with the upper edges of the case and guide the hooks outward beyond the upper edge where they move further downward while always being maintained in contact with the outer end walls of the case. Toward the end of the downward movement, end portion hooks 100 are positioned below the lower edges of minor flaps 28*a* to later raise the flaps (FIG. 10B).

In operation, the combined tab slitting and case flap separation function are as follows. Viewing FIG. 4, as case 28 moves along a linear path at tab-lock slitting section 62, knife 55 slides adjacent to the inner side walls of the case and behind the inner major flap 28*d*. Continued motion causes knife 55 to cut tab-lock 29 which secures the inner major flap 28*d* with rear minor flap 28*a* in position against the vertical walls of the case. Once the flaps are separated the major flap is engaged by flap guide 56 and elevated to a position away from the side wall. During tab-lock slitting, case 28 is positively retained from vertical movement by upper guide plate 58.

Further movement through case packing and flap separation station 18, moves case 28 into second slitting section 64 and along a second linear path 61 (FIGS. 5, 6, and 8A). Blade 80 is normally positioned with separating or positioning blade 81 in the raised position. As the case is moved through the second slitting section, separating blade 81 slides between the vertical wall of case 28 and outer major flap 28*b* separating the flap from engagement with the vertical wall. As the case moves into position above slitting blade or knife 82, sensor 83 actuates drive 84 to cause blade 80 to pivot bringing slitting blade or knife 82 into position to cut tab 29 separating the outer major flap from front minor flap 28*a*. Outer flap guide 86 is located adjacent and downstream of knife 82 and acts to engage and elevate the outer major flap as case moves out of the second slitting section. Both the inner and outer major flaps are now elevated above their respective sidewalls. Simultaneously with the operation at the second slitting section, pickup and grid heads 22, 24 are moved through a second compound motion which guides the case and the slug of articles with the compartments of the case to move in a linear path 64. After tab-lock slitting, the pickup heads are actuated to release the articles at 73, and move out of the case. As earlier described at slitting section 64, hooks 100 upon upward movement of pickup and grid heads 22, 24 are themselves moved into engagement with the lower edges of the front and rear minor flaps 28*a*, 28*c* and upon continued upward movement of the heads, the hooks elevate these flaps.

Flap Sealing Section

Figure 11A:
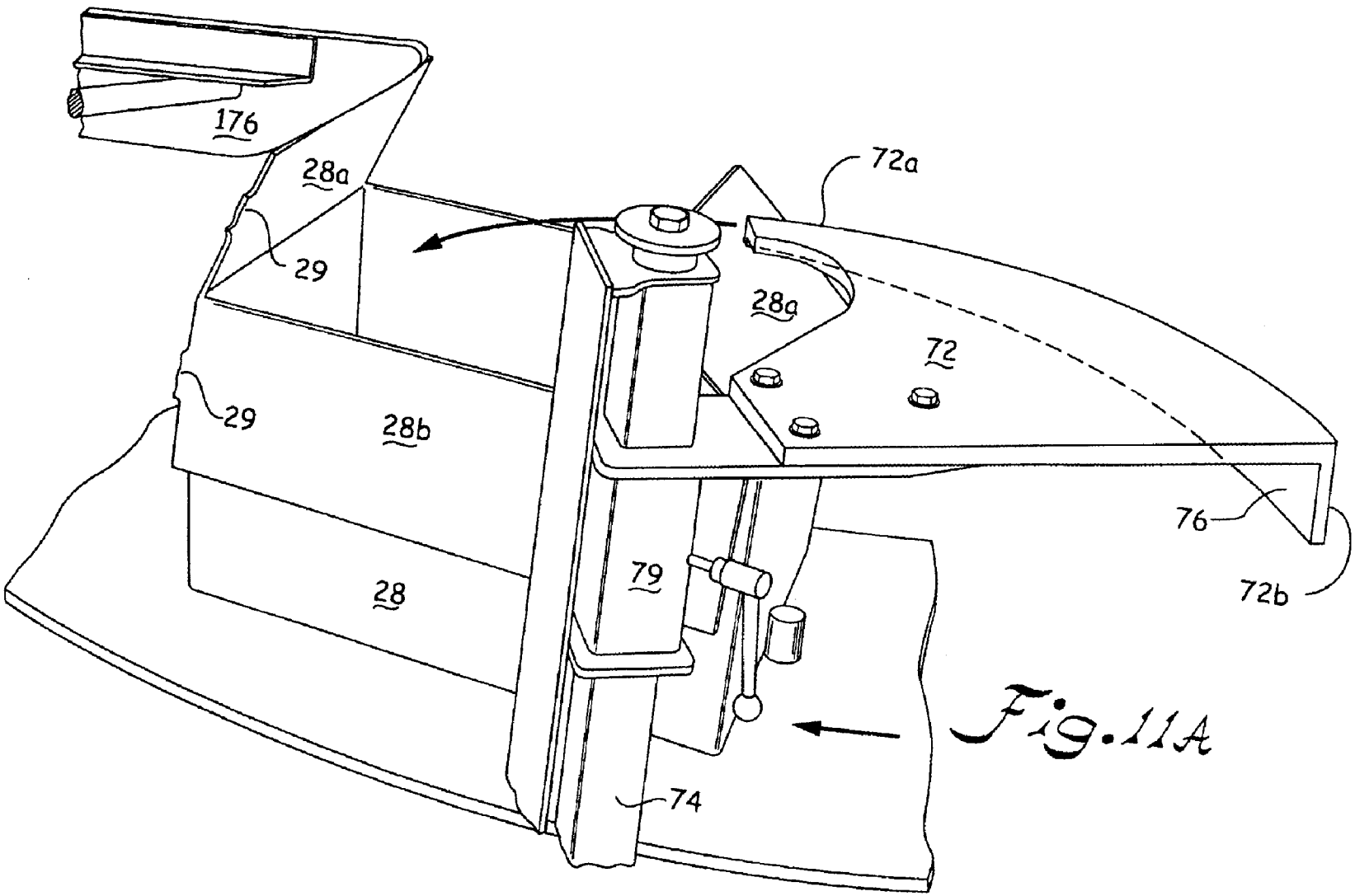
FIG. 11A is an exploded view of the entry of a case exit station preparing the case for exiting the rotating conveyor plate.
Figure 11B:
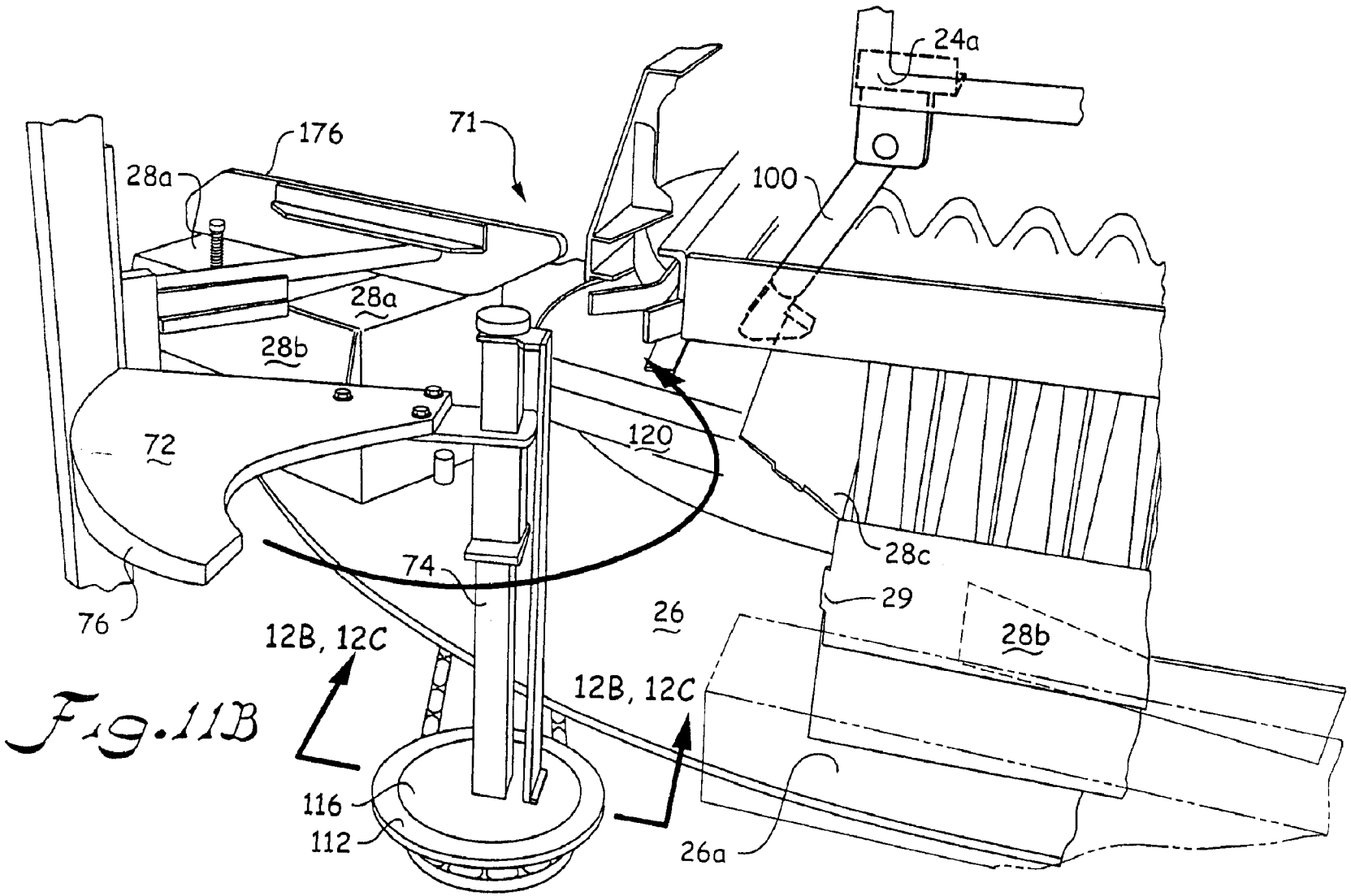
FIG. 11B is similar to FIG. 11A showing the minor flap in closed position beneath the positioning rail.
Figure 13A:
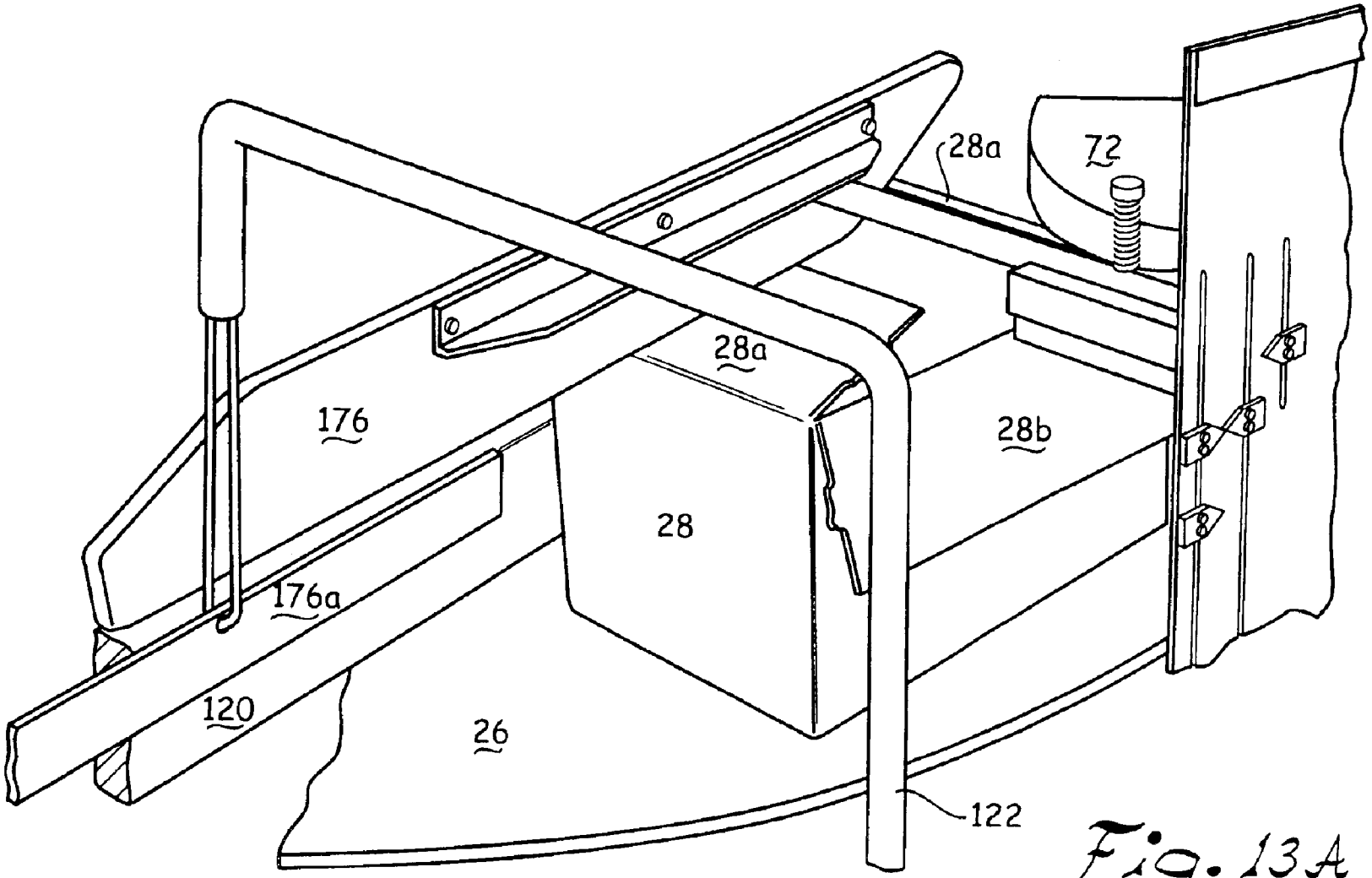
FIG. 13A is an exploded view of the entry area of a flap sealing apparatus with the positioning rail folding down the raised front minor flap.

Turning now to FIGS. 3, 6, 11A and 11B, a case exit section 71 is provided to initially received packed cases 28 with their front and rear minor flaps raised by way of hooks 100 for passage through a flap sealing section. The exit section includes a pair of minor flap positioning members. A first of the positioning members comprises a rotating plate or disc 72 located adjacent the exit area of the deposit and slitting station. Plate or disc 72 is carried by a vertical shaft 74 which is rotated in timed sequence with turret B and plate 26. Disc 72 is vertically adjustable along shaft 74 to accommodate different size articles and cases. Plate 72 includes a wedge-shaped outer edge 76 which, as shown in FIGS. 6, 11A and 11B, increases in height from front to rear, e.g., from 72*a* to 72*b*. Plate 72 is also substantially wedge-shaped with its periphery comprising about ⅛ of the circumferential arc along which outer edge 76 moves. An adjustment assembly 79 secures plate 72 with shaft 74 in a desired vertical position. In operation, case 28 moves from case packing and flap separation station 18 into exit section 71 with its minor rear flap in the slightly raised position brought about by hook blade 100 (FIG. 11B). As the case moves into the exit section the rear minor flap 28*a* is engaged by the forward end 72*a* of disc 72 and through rotation of the disc is moved to a substantially sealed position by edge 76. Because disc 72 is moving faster than case 28 is moving, it passes over the case pushing the rear flap into the sealed position while the case is being directed into the exit section 71 (FIGS. 3B, 11A). Simultaneously with this action the forward end of case 28 with the forward minor flap 28*c*, also slightly raised, moves under a second positioning member in the form of positioning rail 176 which engages and folds down the forward minor flap (FIG. 13A). Further movement of case 28 positions folded down rear flap also under rail 176.

Figure 12A:
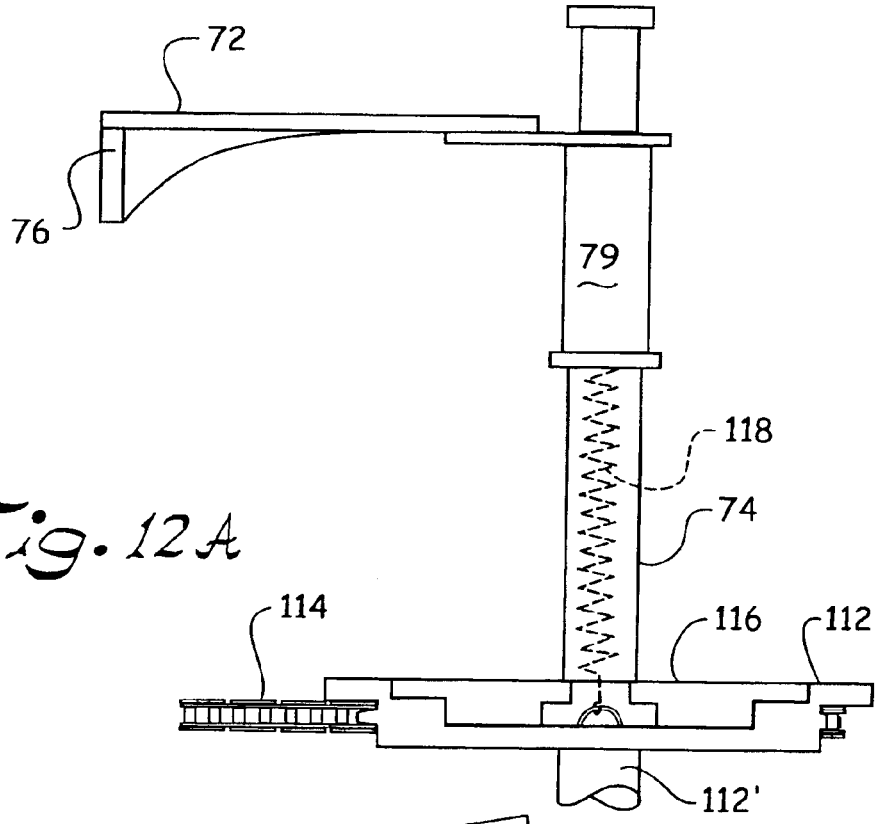
FIG. 12A is a side view showing the rear flap closing disk and mounting structure according to the invention.
Figure 12B:
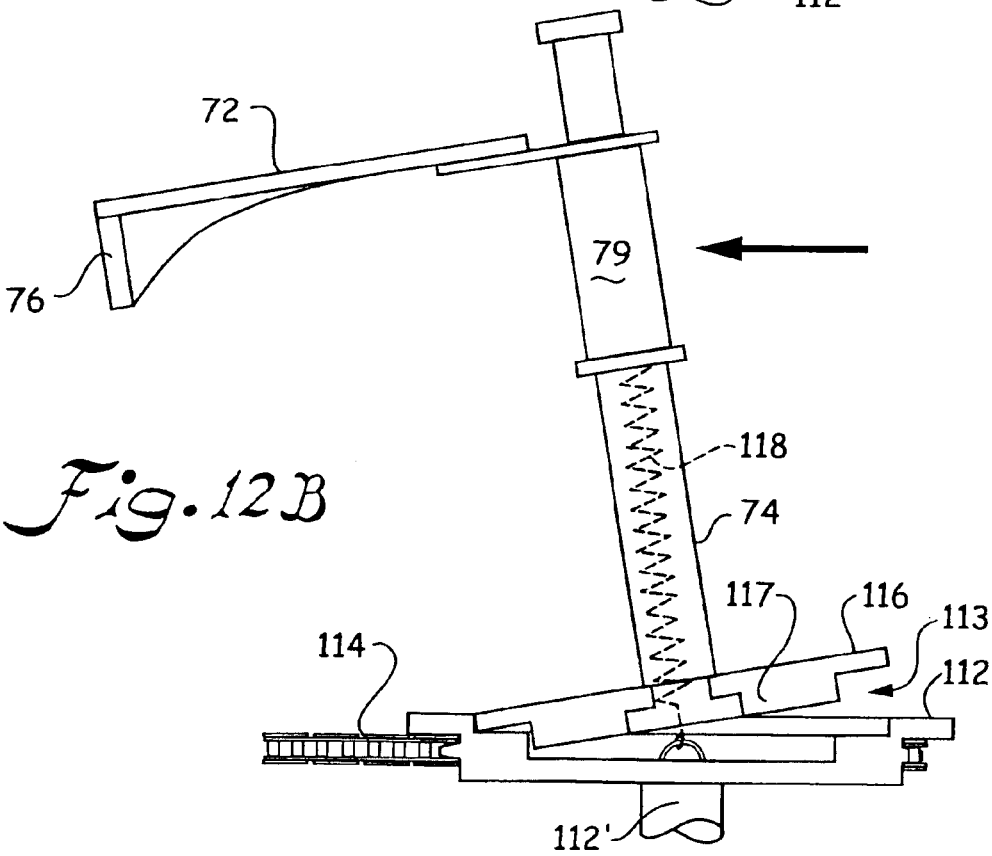
FIG. 12B is similar to FIG. 12A showing flap closing disk mounting structure in a break away position.

Turning now to FIGS. 12A and 12B, a breakaway mounting for shaft 74 is provided. The breakaway mounting includes drive disk 112 carried by shaft 112' which is driven by chain 114 from the main drive. The upper surface is formed with a shaped face 113 mounted to the lower end of shaft 74 is a plate 116 provided with a lower shaped face 117. Faces 113 and 117 are designed to intermesh as shown in FIG. 12A. A resilient connector 118 which extends through shaft 74 is engaged in face 113 and in an upper portion of shaft 74. Connector 118 acts to maintain face 117 of shaft 74 in positive engagement with face 113 of disk 112 allowing the rotation of disc 112 to rotatably drive shaft 112. Because shaft 74 is located adjacent the edge of plate 28 and adjacent the entrance of exit station 71 it is sometimes in position to become engaged with a filled case which for some reason becomes misaligned during movement through the exit section. If shaft 74 is unyielding considerable damage can be done before the packing machine can be stopped. In order to eliminate this problem shaft 74 is provided with the above described breakaway mounting to plate 112. This allows shaft 74 to be knocked or driven out of position by a misaligned case as shown in FIG. 12B. By providing this break away mounting, damage is kept to a minimum.

Figure 13B:
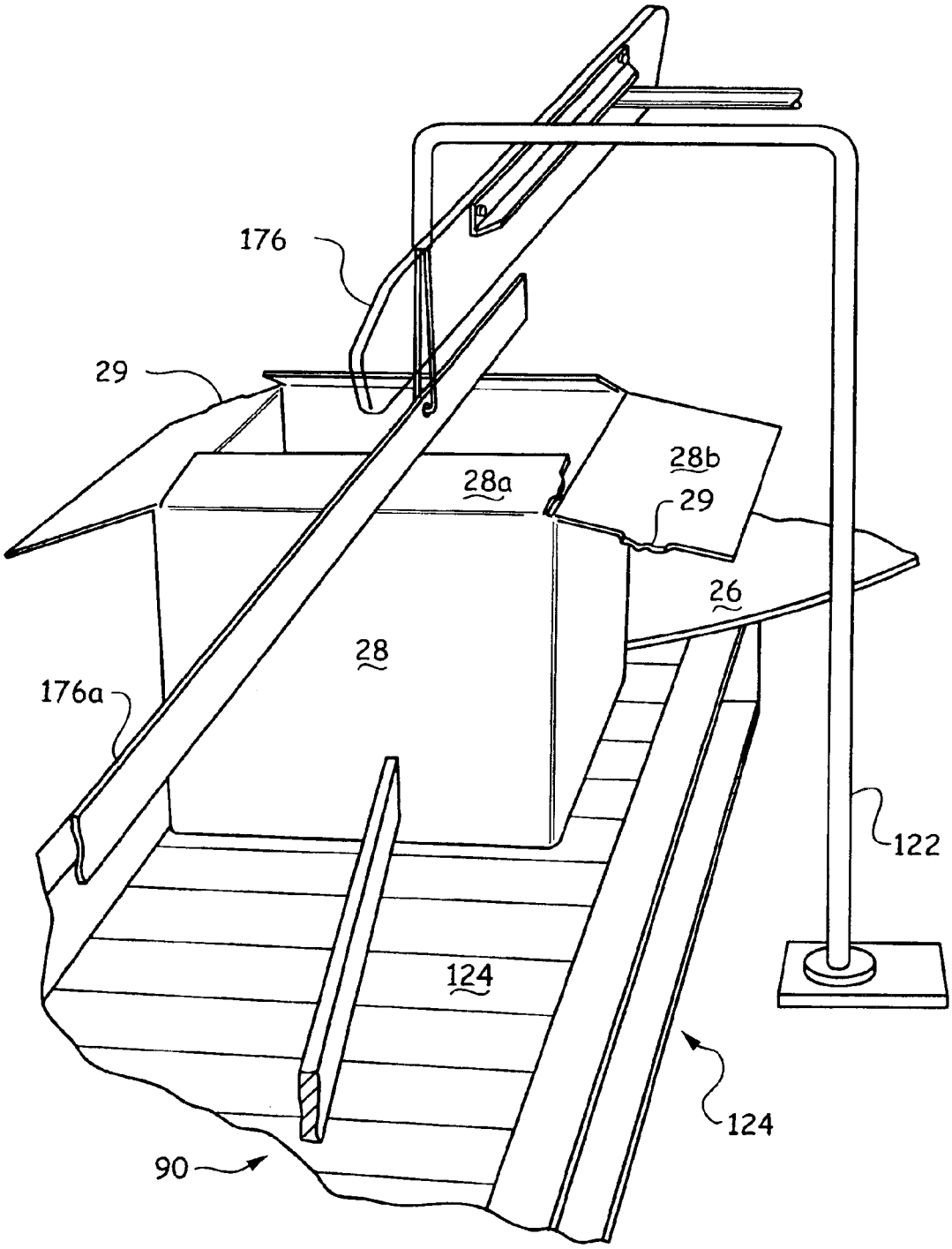
FIG. 13B is a progression of FIG. 13A showing the front and rear minor flaps being moved into a closed position by the positioning rail.
Figure 13C:
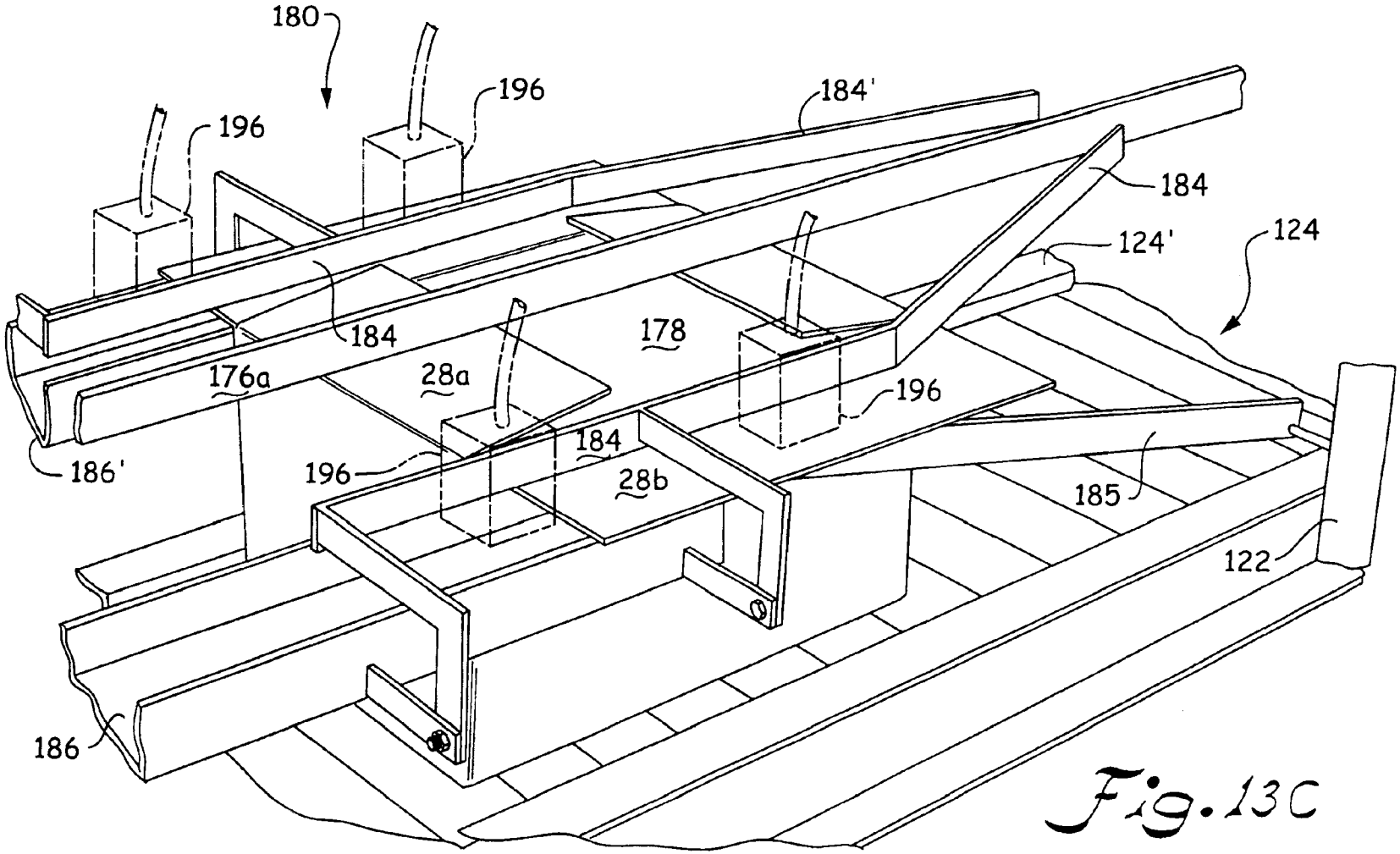
FIG. 13C is a progression of FIG. 13B showing the major side flaps being positioned to receive adhesive.

Turning now to FIGS. 3, 11B, 13A–13D, removal guide 120 is connected with frame 122 adjacent the receiving end of removal conveyor 124 and extends across plate 26 at exit section 71 (FIG. 13B). Removal guide 120, which is aligned with rail extension 185', acts to deflect each case 28 onto removal conveyor 124. During the time in which guide 120 is deflecting the case onto the conveyor, positioning rail 176, 176*a* is positioned to hold down front and rear minor flaps 28*c*, 28*a*. As case 28 continues to be moved by conveyor 124 into sealing section 180 minor flaps 28*a* continue to be held down by positioning rail extension 176*a*.

Sealing section 180 includes a pair of major flap guide and support rails arranged on each side of conveyor 124 and identified as 186, 186'. The guide and support rails include forward extensions 185, 185' which are attached at their forward ends with frame 122. The guide and support rails are positioned adjacent the upper edge of case 28 as it is moved through a forward section of the sealing section 180. Guide and support rails 186, 186' are positioned to engage beneath major flaps 28*b*, 28*d* and to bring them upward into a position which is substantially perpendicular of the vertical side walls and to hold them in that position during the application of adhesive.

Arranged above each guide and support rails 186, 186' is an upper flap guide rail 184, 184' with forward ends extending upwardly and toward exit section 71. The upper guide assembly comprising an upper rails 184, 184' which are positioned slightly above guide and support rails 186, 186' and act to position and maintain each major flap 28*b* horizontally onto the guide and support rails during movement of the case through the adhesive application area. A plurality of adhesive applicators are located over and adjacent support rails 186, 186' in position to apply adhesive onto major flaps 28*b*. 28*d* as case 28 is moved through the adhesive application area. Simultaneous with case 28 passing from exit section 71 and onto conveyor 124 and through the adhesive application zone of sealing section 180, front and rear minor flaps 28*c*, 28*a* are retained in the sealed position first by guide rail 176 and then guide rail extension 176*a* which extends beyond the adhesive application station.

The flap sealing operation, thus far described, operates in the following manner. Guide 120 deflects packed case 28 onto conveyor 124 with front and rear minor flaps 28*b* held in the sealed position by rail 176 and 176*a*. As the case is moved away from conveyor plate 26 major flaps 28*b*, 28*d* are engaged by extensions 185, 185' of the guide and support rails and brought into a substantially horizontal position as the case is moved along the adhesive application area 178. Simultaneously upper guide rails 184, 184' align over the upper sides of major flaps 28*b*, 28*d* to bring them into a substantially fixed position on support rails 186, 186' and the upper guide rails during movement through the adhesive application area.

Figure 13D:
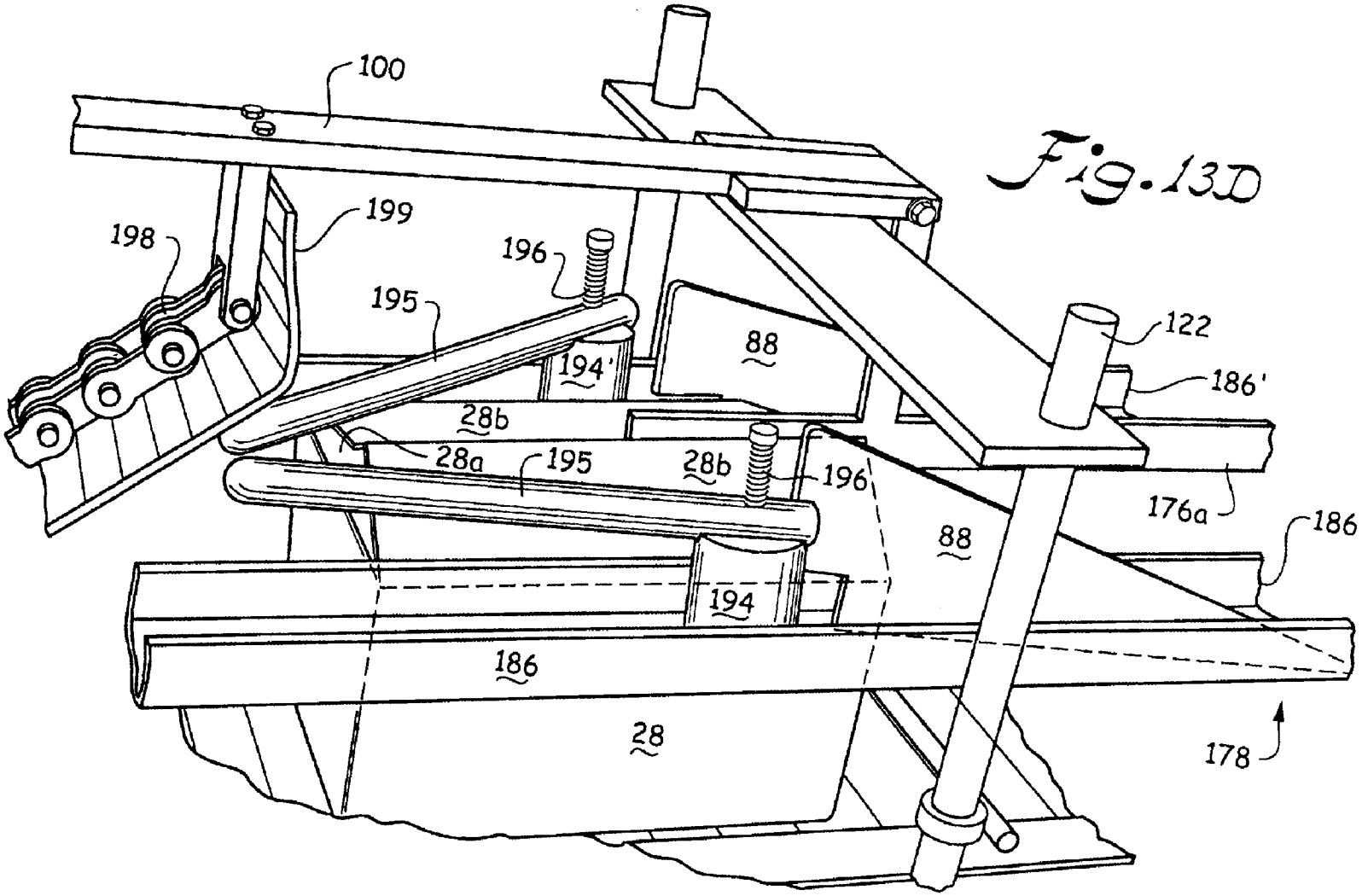
FIG. 13D is a progression of FIG. 13C showing the top flap closing structure.
Figure 13E:
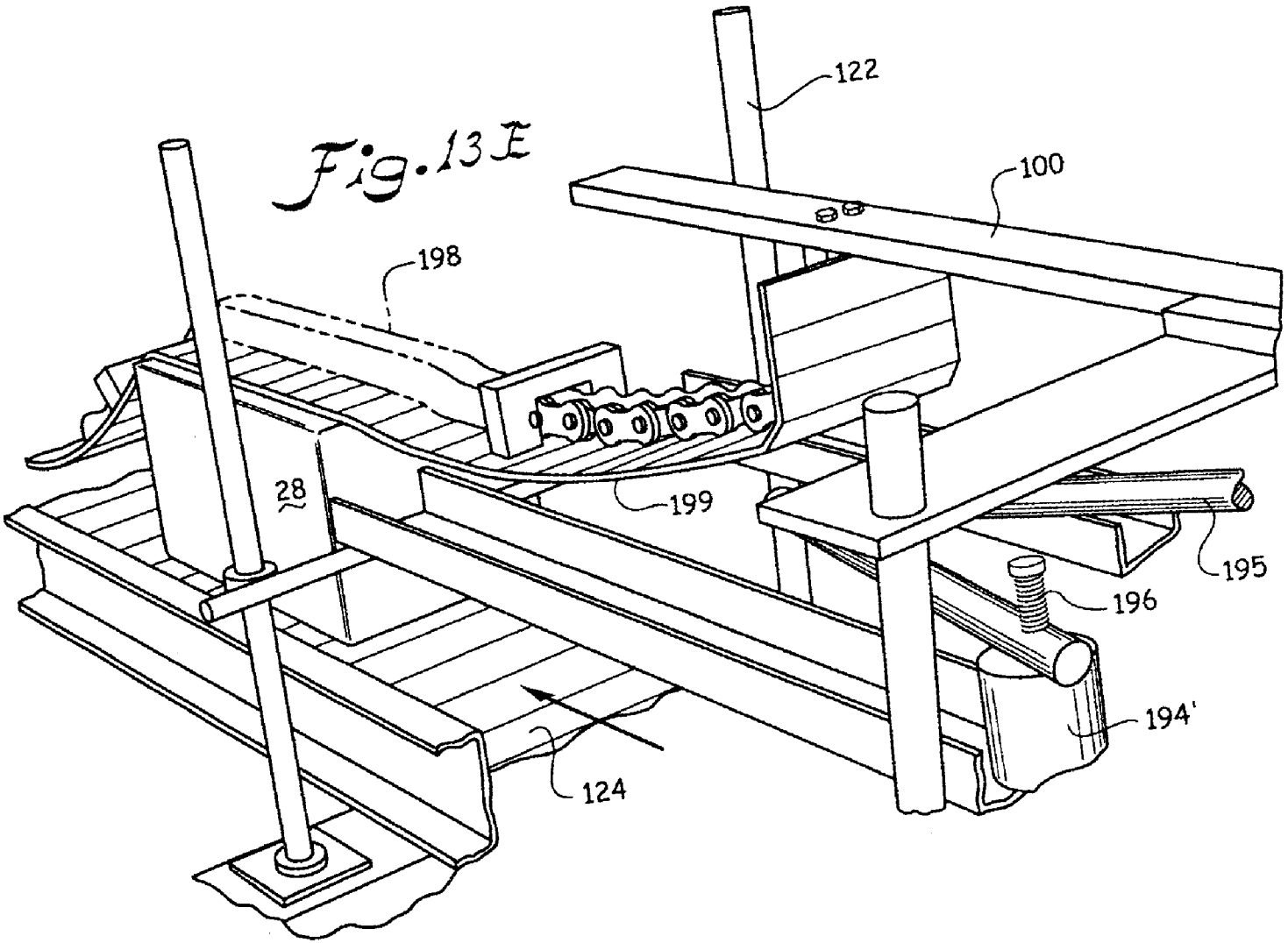
FIG. 13E is a progression to FIG. 13D showing the retaining structure for holding the closed flaps in position allowing the adhesive to set.

Substantially simultaneously with the positioning of the major flaps in the horizontal position, adhesive applicators 96 are actuated to apply adhesive onto the upwardly facing surface of major flaps 28*b*, 28*d*. Immediately adjacent the downstream end of adhesive application area 178 there is provided a pair of inwardly and upwardly directed wedges 88. Wedges 88 are designed to engage beneath the outwardly extending major flaps as they leave area 178 and urge them upwardly into a substantially vertical position during continued movement of the case and best shown in FIG. 13D. A pair of spring biased arms 195 are pivotally mounted on supports 194 carried by rails 186, 186'. Arms 195 are resiliently urged in a downwardly and inwardly direction as shown in FIG. 13D. Arranged adjacent and slightly over the downstream ends of arms 195 is a sealing weight which comprises a chain 198 carried by support arm 200 and frame 122 in a position over takeaway conveyor 124. Secured with the under side of chain 198 is a flexible pad 199. In operation once the adhesive is applied to major flaps 28*b*, case 28 is moved from adhesive application area 178 and between wedges 88. As the case advances, wedges 88 engage under major of flaps 28*b*, 28*d* and guide them upwardly into a substantially vertical position. At this point the case has advanced into position where depressing arms 195 carried by supports 194' engage with the outer sides of the vertically positioned flaps. Continued movement of the case causes arms 195 to urge, through the inward pressure of springs 196, flaps 28*b*, 28*d* into the sealed position as best seen in FIGS. 13D and 13E.

Immediately following the sealing action brought about by arms 195, case 28 is moved beneath pad 199 carried by chain 198 of the sealing apparatus. Due to the weight of chain 198, major flaps 28*b*, 28*d* are firmly urged onto minor flaps 28*a*, 28*c* and held in this position during the remainder of the movement through the sealing section. The duration of the movement beneath chain 198 is dependent upon the time required for the adhesive to set and seal the flaps in the sealed position. Sealed, packed cases carried on conveyor 124 emerge from the sealing station 180 and are directed for further distribution.

It has been found according to the present invention that weighting the cases with articles during tab-lock slitting is advantageous because the weight of the packed cases holds the case down while the slitting knives or elements sever the tab-locks. Also, if the pickup heads continue to grip the articles packed into the cases during tab-lock slitting, the cases can be guided through the tab-lock slitting sections. Since a generally straight-line or linear path through the slitting section is desirable, the pickup heads can again be caused to depart from a pure radial path and move in a straight-line through the slitting sections to guide the cases correspondingly. Accordingly, referring now to FIGS. 14 through 18C, another embodiment of a case tab-lock slitting and flap closure apparatus and method will be described wherein the articles are inserted in the cases during severing of both tab-locks. The apparatus includes a first tab slitting section 211 along radial path 60 and radial transport path 25 of rotary conveyor 26 that includes a first tab slitting mechanism assembly, designated generally as 210, for severing a first, rear tab-lock 29*a*. The apparatus includes a second tab slitting assembly, designated generally as 220, for severing a second, front tab-lock 29*b* of the case (FIG. 15). Both assemblies are disposed well downstream of pickup station 16 and generally at the same location at case packing and flap separation station 18 so that the articles have been inserted in the cases during both tab-lock slittings. Preferably, at the time the tabs are slit, the pickup heads and articles have been lowered into the case with the pickup heads still gripping the articles. In this manner, a firm hold down pressure is exerted on the case while the tabs are cut, and the case is guided generally in the same linear path of the pickup heads. While FIGS. 16A through 17D show the packed articles with the pickup and grid heads omitted for clarity, it is to be understood that the articles remain gripped by the pickup heads from article insertion section 70 to article release section at 73.

Figure 14A:
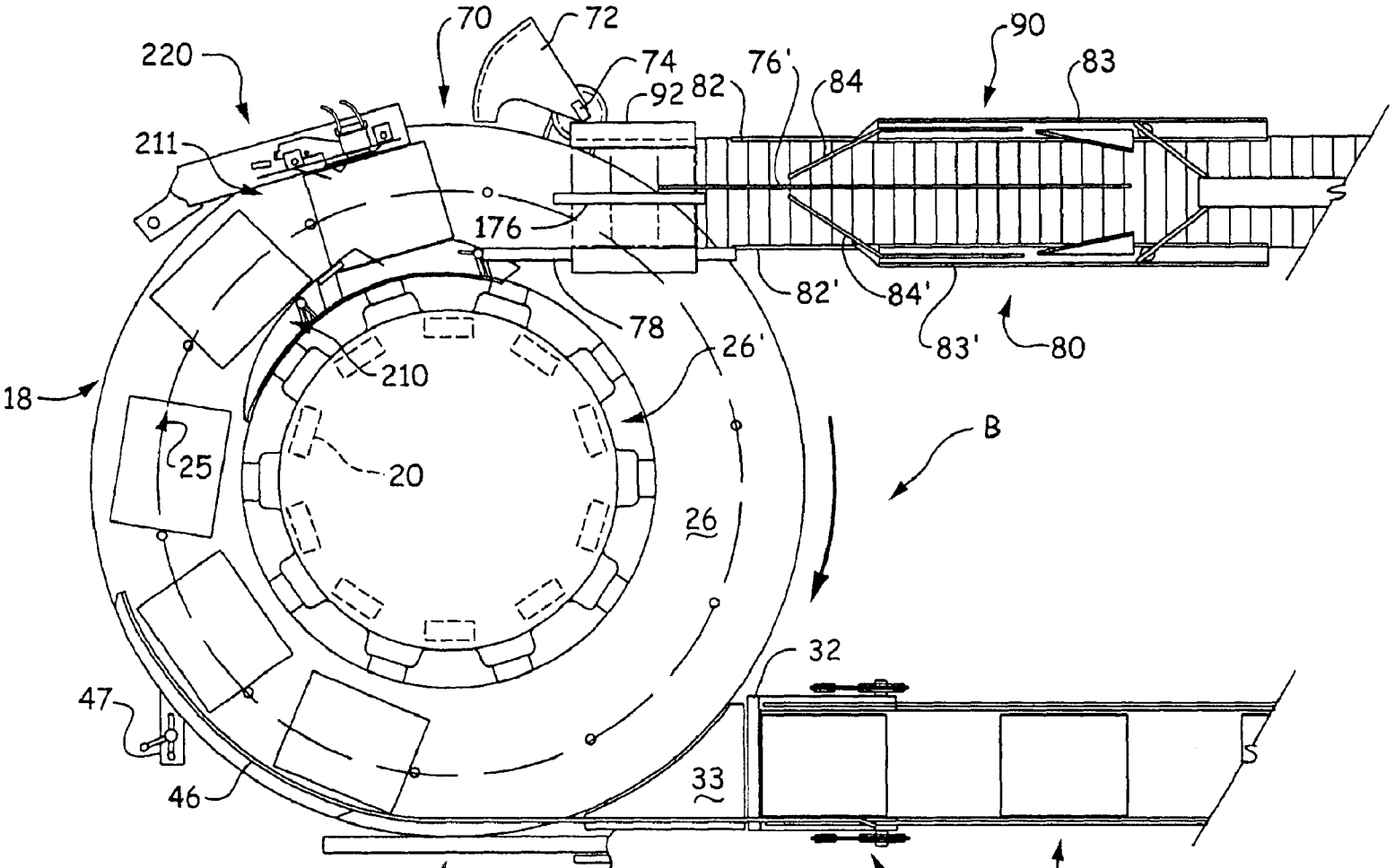
FIG. 14A is a top plan view illustrating another embodiment of the present invention wherein cases are indexed and transported on a rotary conveyor through a case packing and tab slitting station.
Figure 14B:
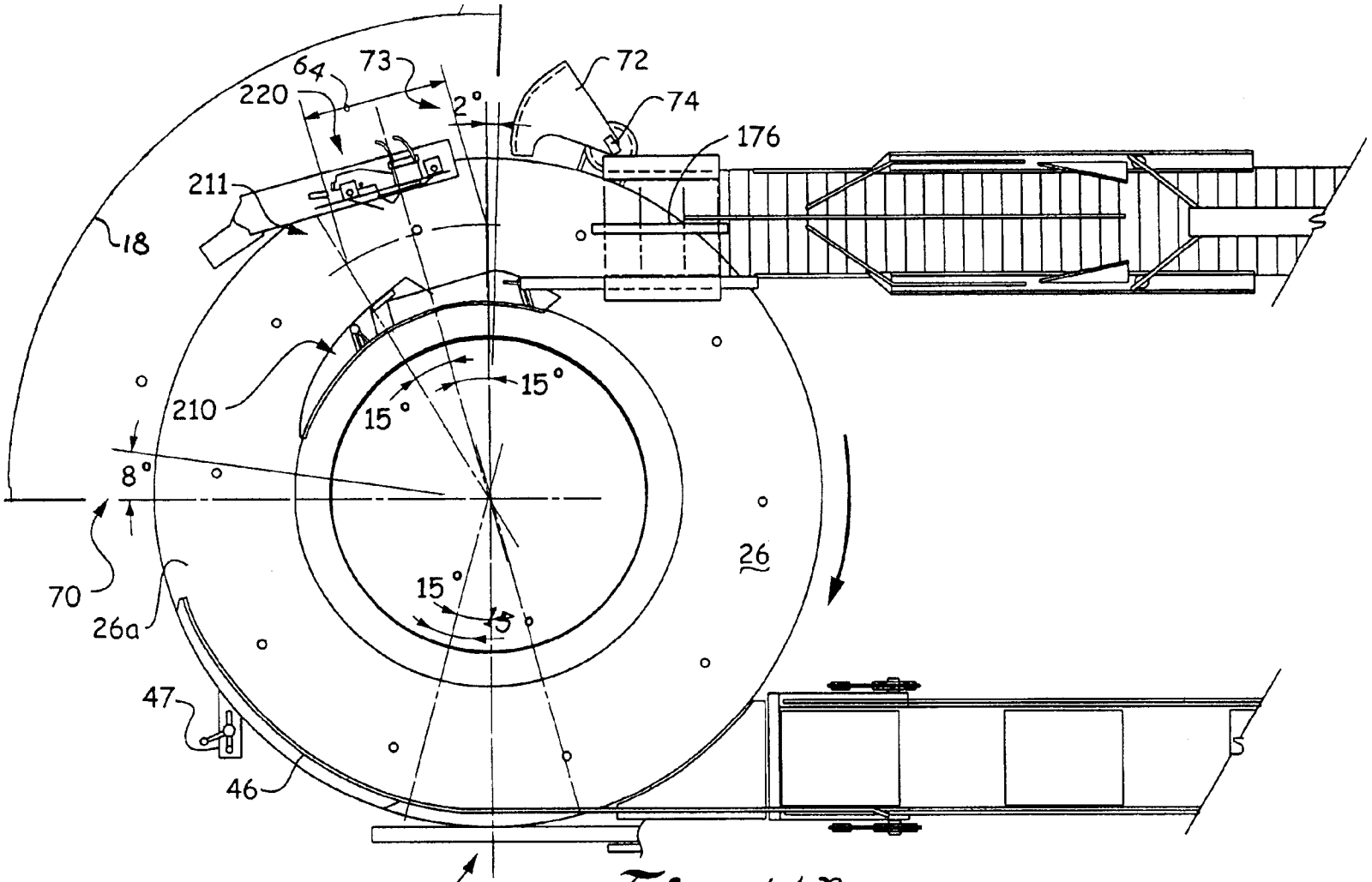
FIG. 14B is a simplified top plan view of FIG. 14A with arcuate process sections illustrated in degrees of rotation for exemplary purposes only.
Figure 15:
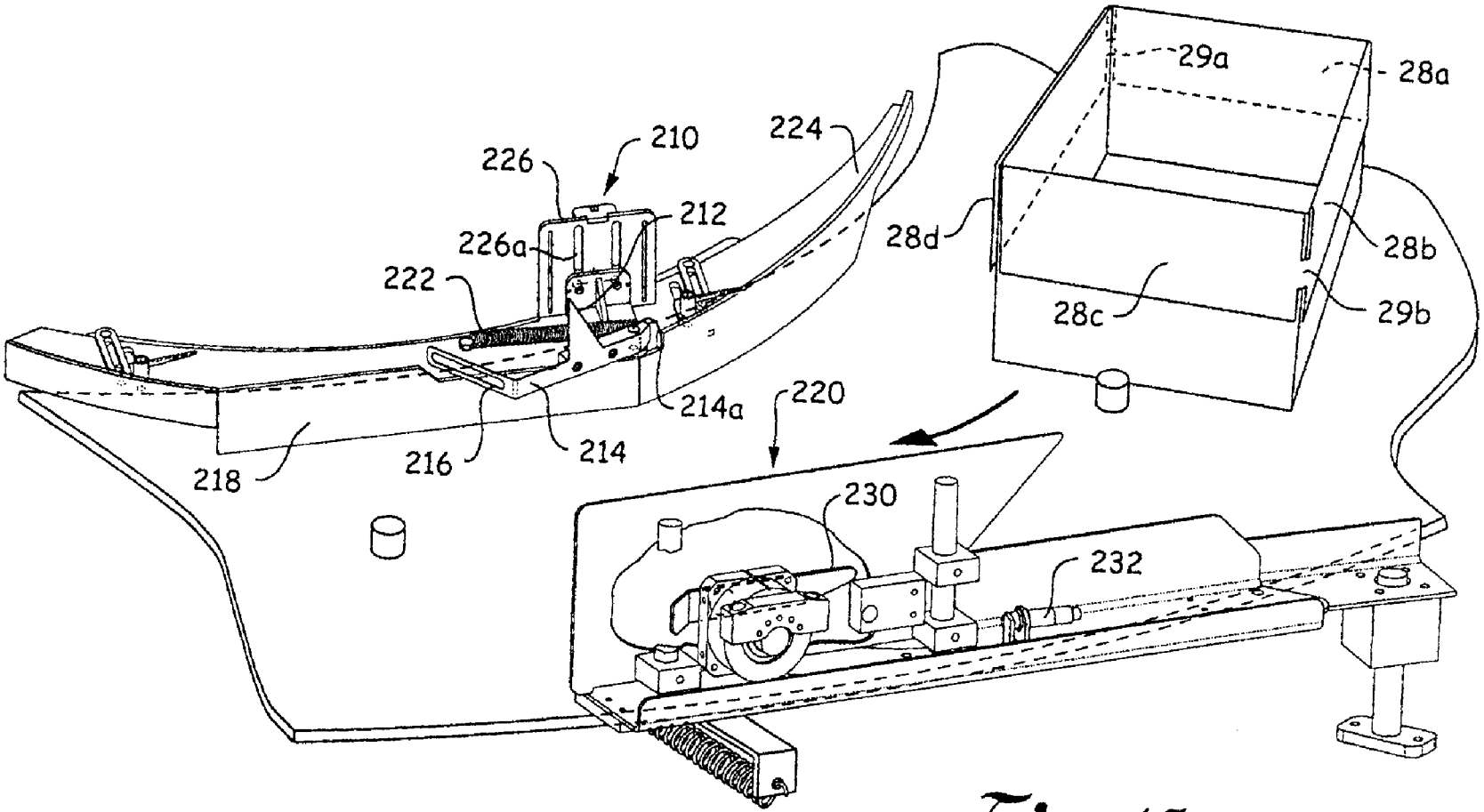
FIG. 15 is an enlarged perspective view taken from the outer side of a rotary conveyor transporting cases through a first tab-lock slitting section of the case packing and tab slitting station.

Referring now to FIG. 14B, the different processing sections along radial transport path 25 of the cases and the radial path 60 of pickup heads will described as referred to generally by arcuate sections of the radial path. First, at pickup station 16 articles conveyed on a separate conveyor are picked up by the radially rotating pickup heads which are caused to divert from pure radial motion and move in a straight line 61 to pick up the articles which are disposed below in parallel alignment. The articles are rotated to the article insertion section, designated generally as 70, which begins with insertion of the grid fingers over an 8° arc indicated, which is followed by lowering of the articles through the grid fingers into the compartments of the case along the remaining portion of the article insertion section. Once the articles are inserted into the case, the pickup heads remain in the grip position gripping the articles while in the cases. Next, the first tab slitting section 210 is encountered and then, briefly downstream, the second tab slitting section 211 is encountered. During passes through the tab slitting sections, the articles remain in the case weighting it down. Also, the pickup and grid heads are moved in the compound motion of secondary rotation and translation to produce linear path 61 for reliable tab-lock slitting. The alignment of the tab slitting mechanisms matches the straight line path of the case. Next, the case with tab-locks severed and flaps elevated enters an article release section 73 wherein the pickup heads are actuated to a release position releasing their grip on the articles. The heads are then moved out of the case with the fingers moving out last over a 2° arc indicated. The packed case with flaps elevated then passes through a case exit section where the flaps are closed and sealed with adhesive, taping, or other means.

Figure 16A:
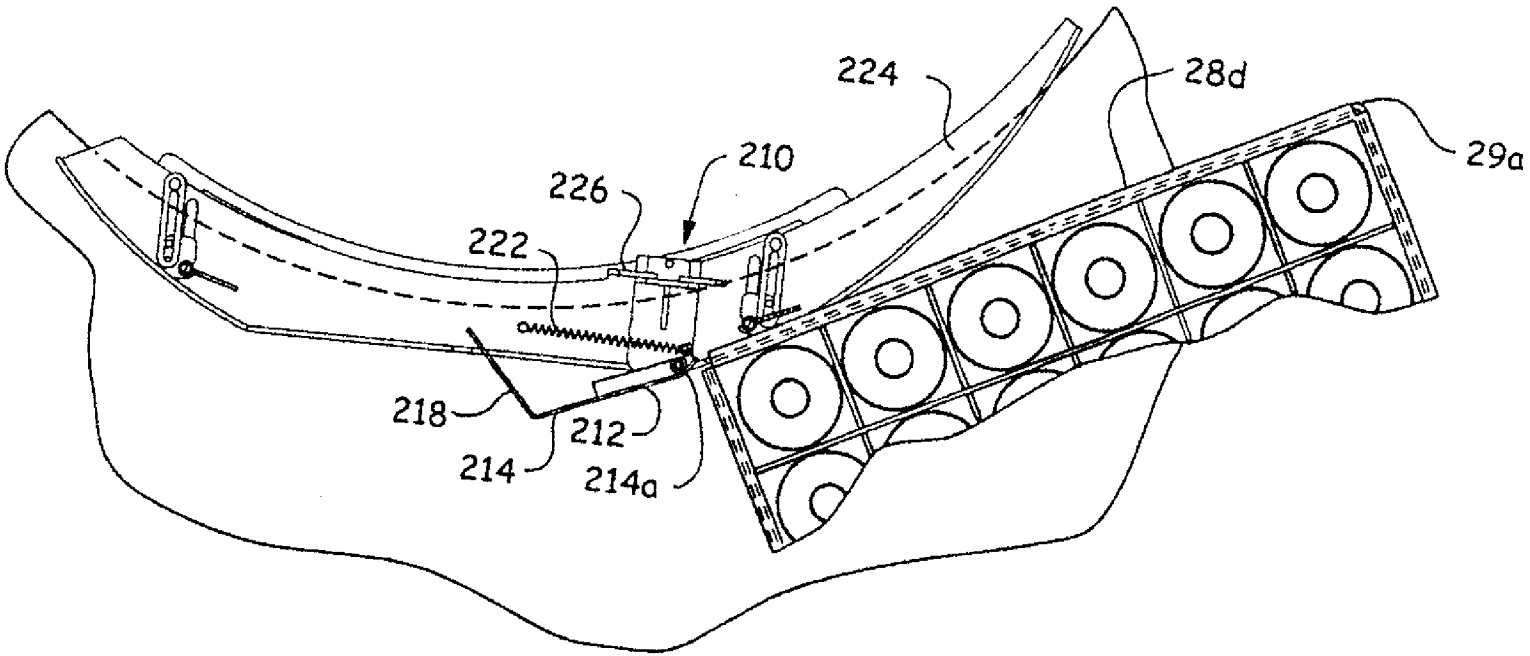
FIG. 16A is a top plan view with parts cut away of a packed case entering the first tab-lock slitting section of FIG. 15 while transported on a rotary conveyor according to the invention wherein the articles are deposited in the case while still being gripped by the gripper head (not shown)
Figure 16B:
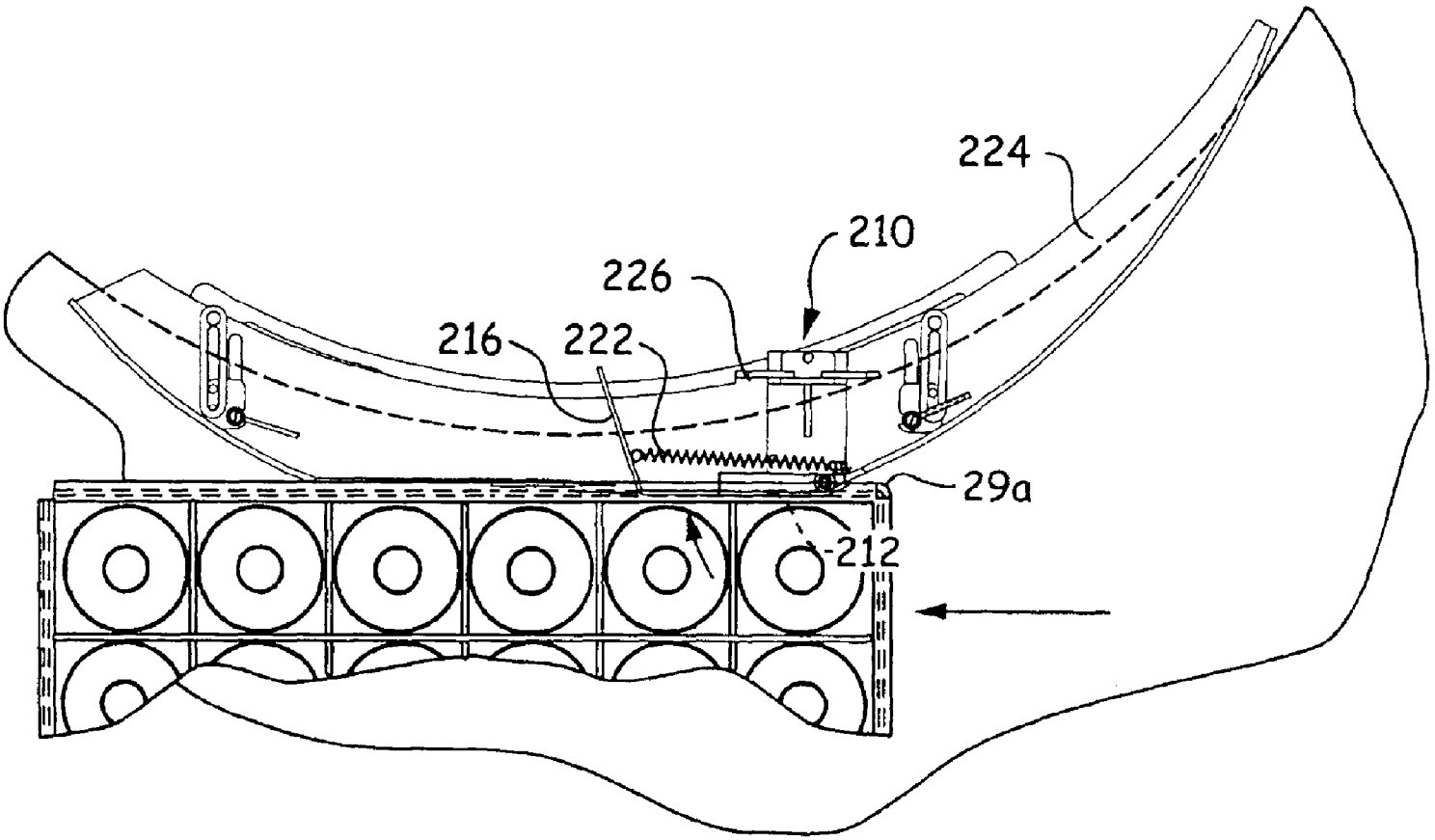
FIG. 16B is a partial top plan view of the case of FIG. 16A wherein the slitter is engaged between a folded vertical major flap and a sidewall of the case prior to engaging the tab-lock.
Figure 16C:
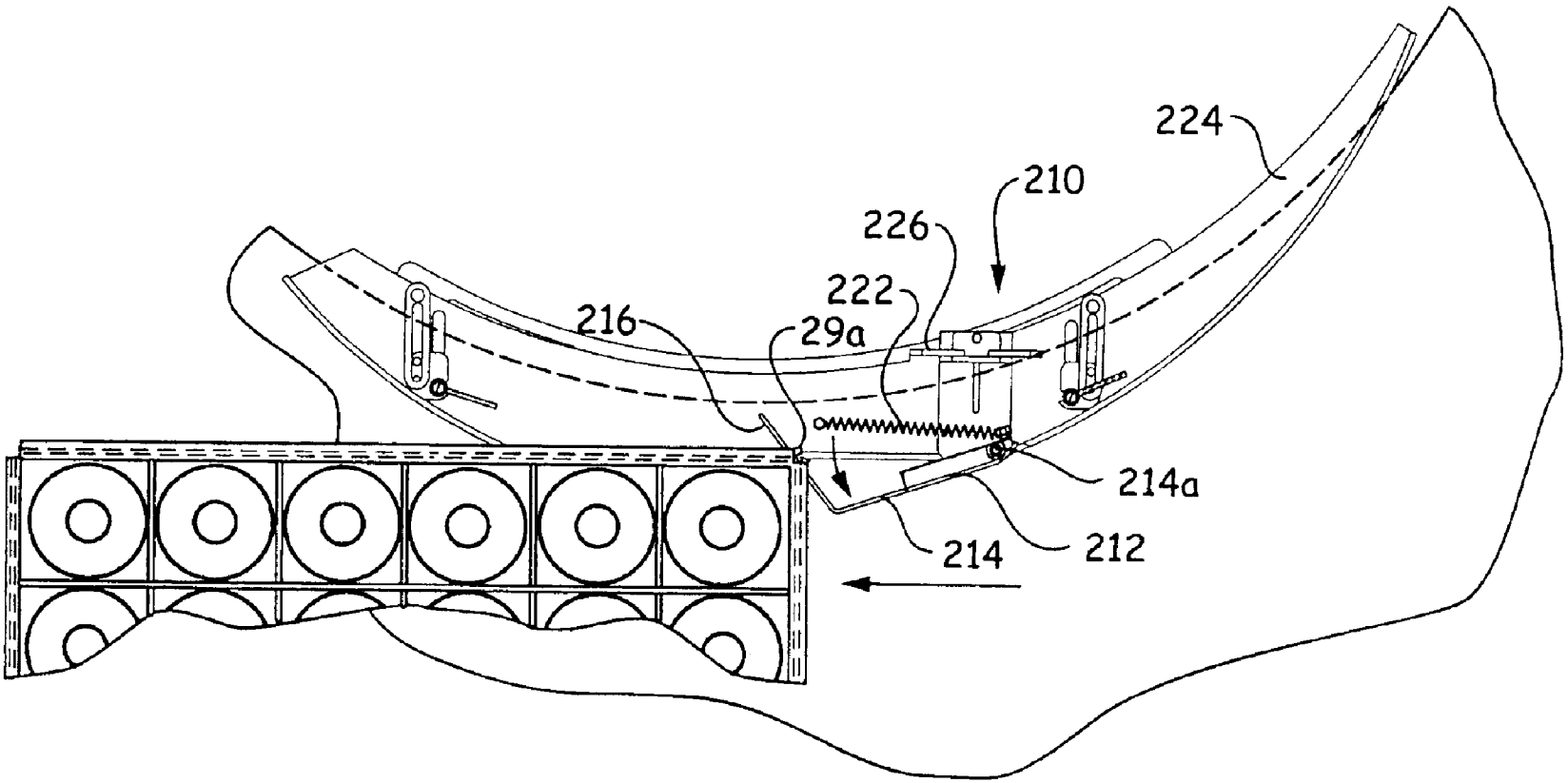
FIG. 16C is a partial top plan view of the first tab-lock slitting section wherein the tab-lock on one side of the case has been severed and the slitter arm has returned into the path of the next case entering the first tab-lock slitting section.

As can best be seen in FIGS. 14B and 15, first tab slitting assembly 210 is disposed on the inside of rotary conveyor 26 for severing rear tab-lock 29*a* as, or slightly before, front tab-lock 29*b* is severed, and second tab slitting assembly 220 is disposed on the outside of the rotary conveyor for severing the front tab-lock. Tab slitting assembly 210 includes a horizontal swing arm 214 having a pivot 214*a* about which the pivot arm and integral tab slitter or cutting blade 212 pivot horizontally. Swing arm 214 includes an angle arm 216 which bears against a top edge of a guide rail 218 for support as blade 212 bears the downward weight of the case when cutting the rear tab. A spring 222 pulls against the swing arm and biases the swing arm outwardly into the path of the oncoming case (FIG. 16A). In this manner, blade 212 is reliably positioned between the flap and case as the case pushes against the swing arm until the swing arm lies flush against the case to engage the rear tab (FIG. 16B). As the case is conveyed forward, cutting blade 212 cuts the rear tab to free major flap 28*d* and minor flap 28 a from each other. Also, for this purpose, a pivoting, leading guide rail 224 is provided which cooperates with a trailing guide rail 218 to guide the case into flush engagement with the blade. Thereafter, guide rail 218 maintains the case and blade in a linear parallel relationship during cutting. Swing arm 214 is mounted on a bracket 226 having slots 226*a* to permit adjustment of the swing arm and blade assembly in the vertical direction.

Figure 17A:
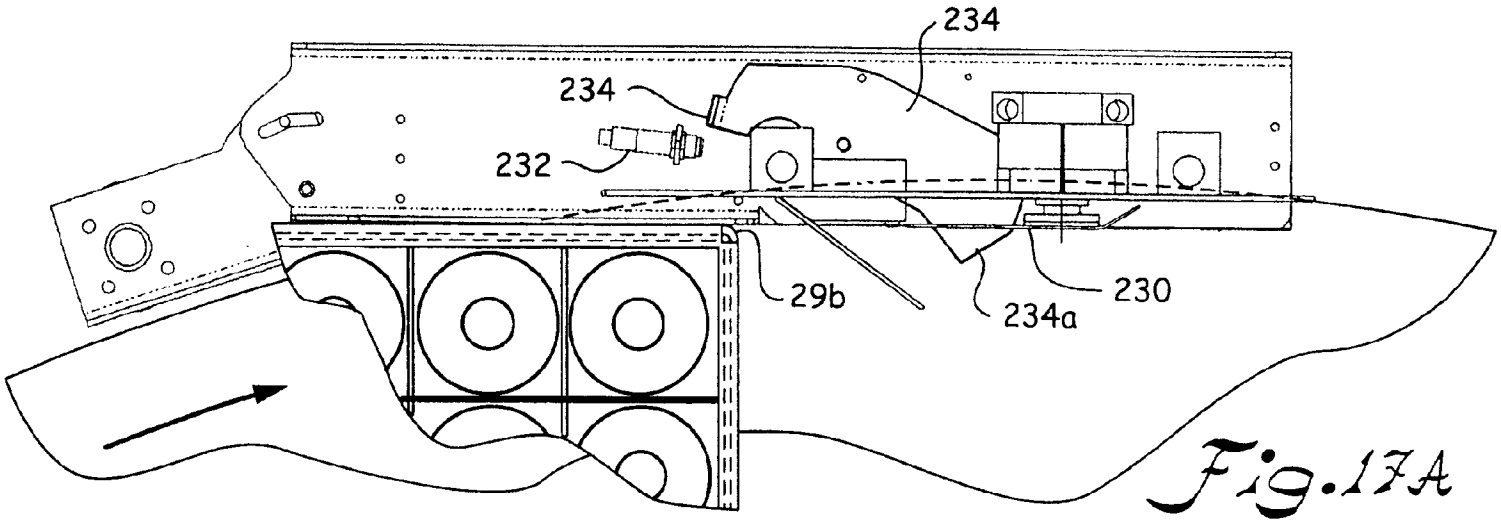
FIG. 17A is a partial top plan view of a packed case entering a second tab-lock slitting section of the case packing and tab slitting station while transported on a rotary conveyor wherein the second slitting mechanism is disposed on an outer side of the rotary conveyor and the articles are still being gripped by gripper heads (not shown)
Figure 17B:
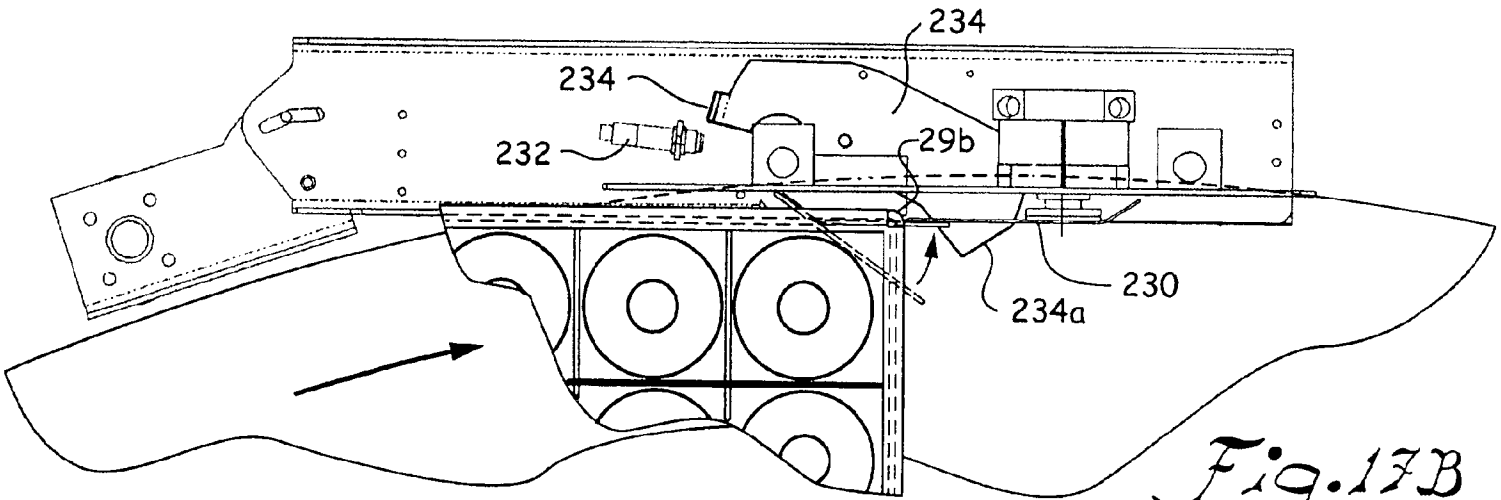
FIG. 17B is a partial top plan view illustrating the case engaging a guard blade and moving the guard out of the transport path to a position overlying a rotary cutter blade.
Figure 17C:
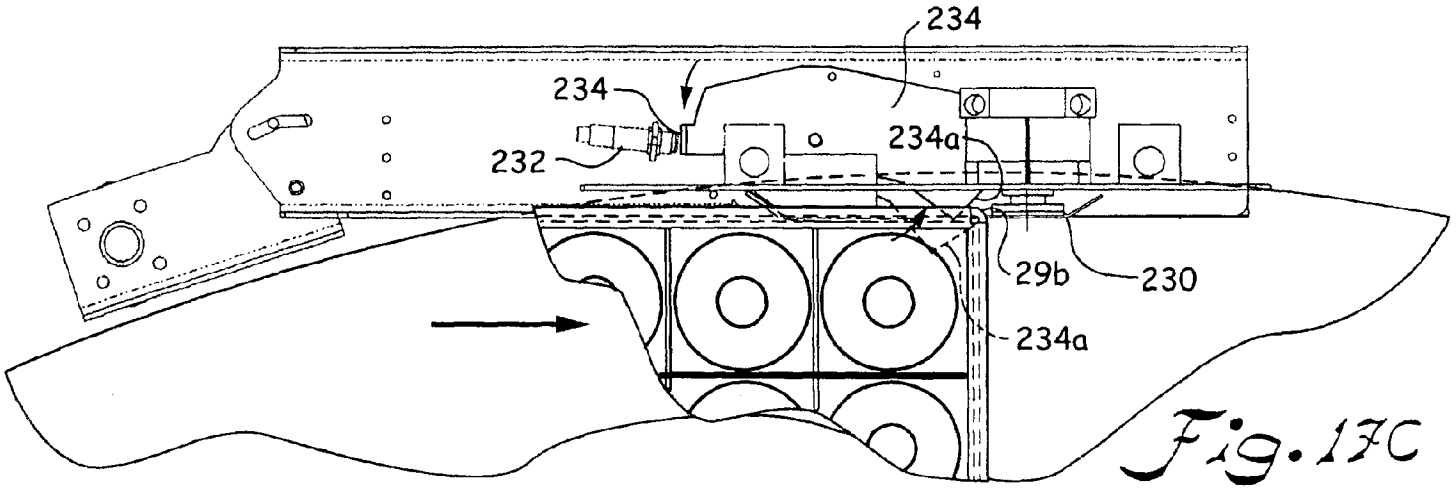
FIG. 17C is a partial top plan view illustrating a case transported on the rotary conveyor in a position where a proximity actuator triggers a proximity switch to activate the rotary cutter blade.
Figure 17D:
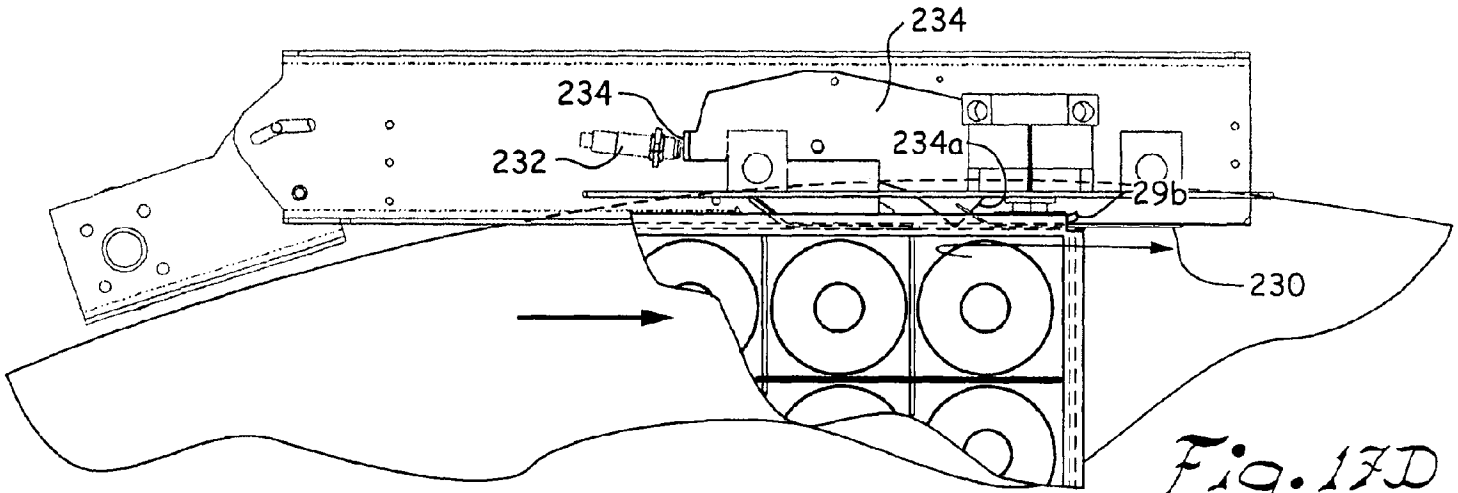
FIG. 17D is a partial top plan view illustrating a case transported on the rotary conveyor in a position where the tab-lock on a second side of the case has been severed to separate second major and minor flaps of the case.
Figure 18A:
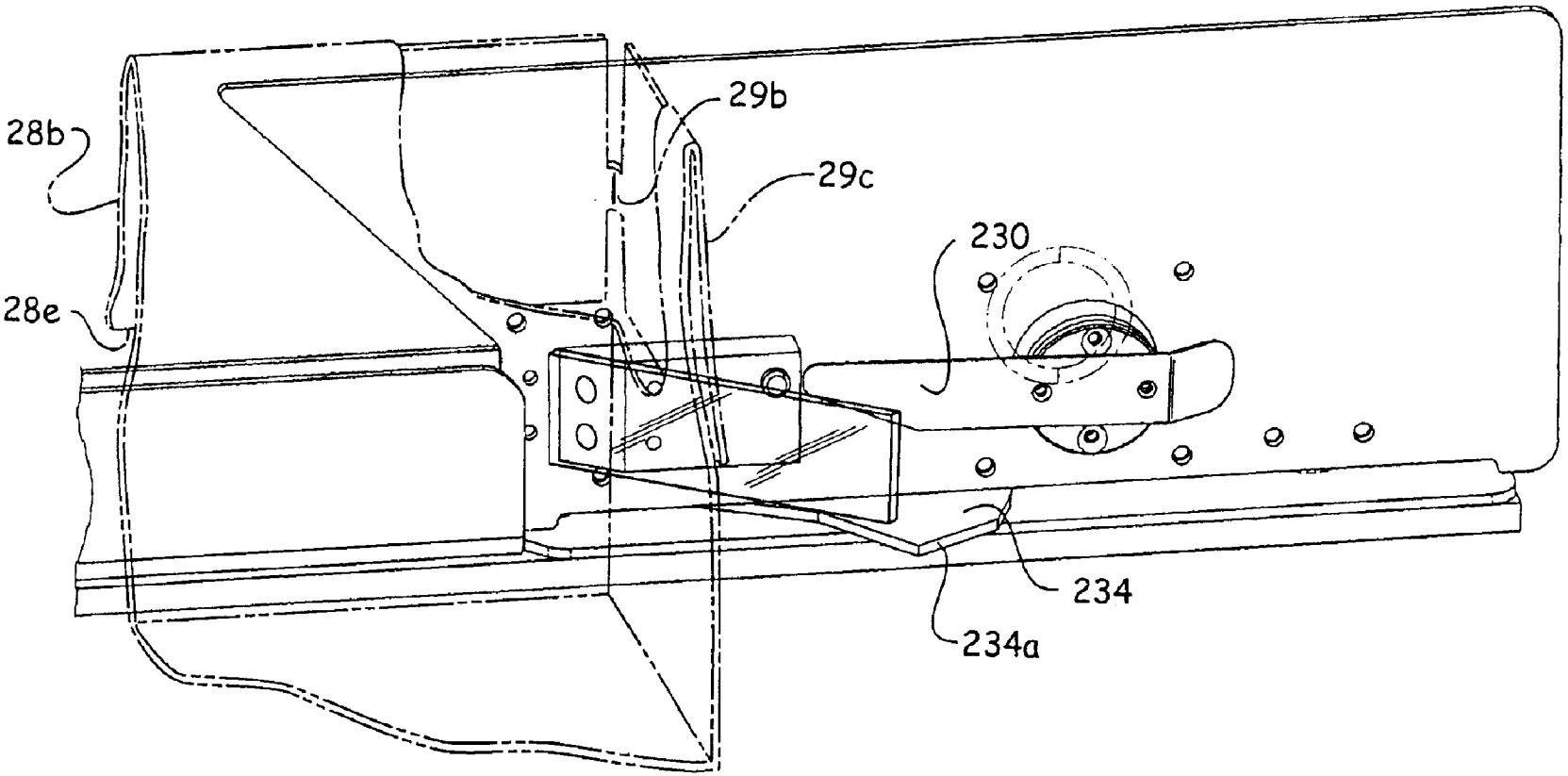
FIG. 18A is a perspective view illustrating a case entering the second tab slitting section with the guard blade extended outward.
Figure 18B:
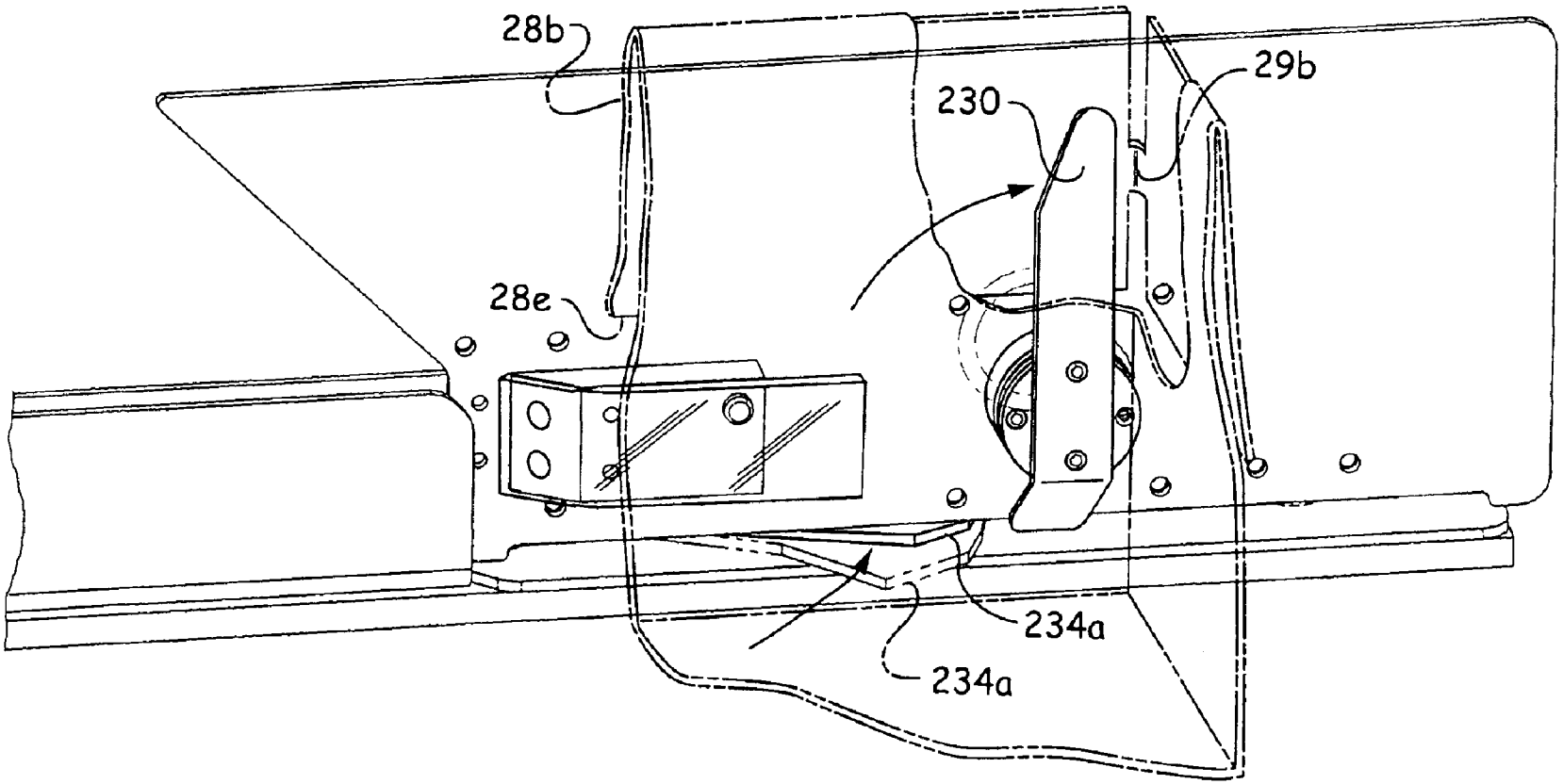
FIG. 18B is a perspective view illustrating the case in the tab-lock cutting position wherein the guard blade is moved flush with the side of the case allowing the rotary cutting blade to rotate and sever the tab-lock.
Figure 18C:
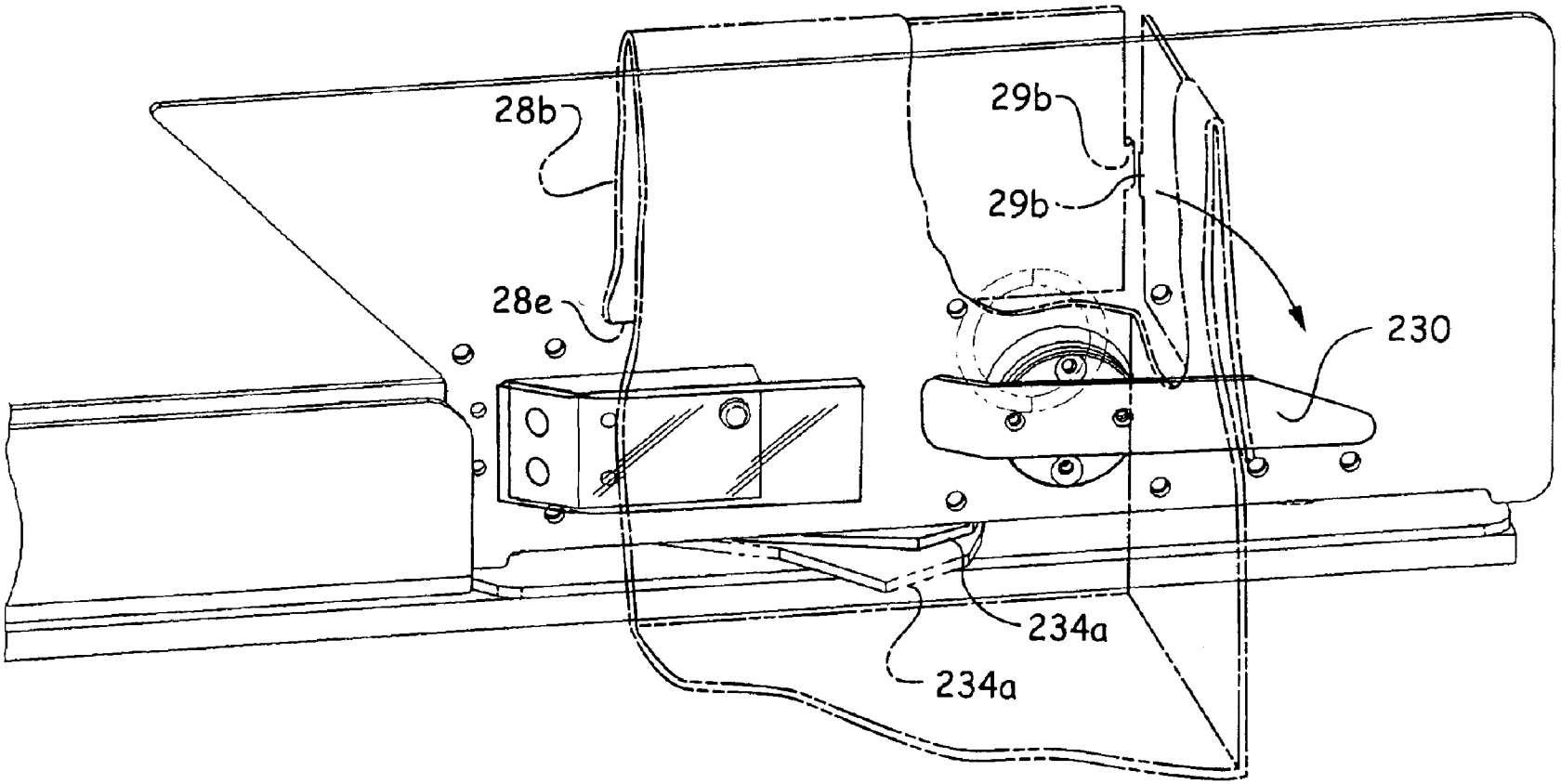
FIG. 18C is a perspective view of the case transported on a rotary conveyor illustrating the rotary cutter blade in a position wherein the blade has rotated 180 degrees and severed the tab-lock.

As can best be seen in FIGS. 15 and FIGS. 17A–18C, second tab slitting assembly 220 includes a rotary, tab cutting blade 230 actuated by compressed air. When actuated, blade 230 rotates 180 degrees to sever the tab-lock (FIG. 18C), and then returns to its unactuated position (FIG. 18A). A proximity sensor 232 is activated by a horizontally swinging trigger arm 234 having a cam portion 234*a* normally extending into the path of the case (FIG. 17A). When the front edge of the case engages cam 234*a*, plate 234 is rotated counter clockwise so that a trigger end 234*b* comes into proximity with proximity switch 232 (FIG. 17C) causing the rotary blade to be actuated and cut front tab 29*b* (FIG. 18C). A blade guard 236, disposed below the folded edge 28*e* of major flap 28*b*, normally extends into the transport path and covers the rotary blade 230 when encountered by an oncoming case. The guard is disposed below the folded edge in a deactivated position, when the blade is not actuated. This protects the blade tip from being hit by the oncoming case, and assures that the blade is not bent outward by the case but instead is maintained parallel to the side of the case. In this manner, the rotary blade is reliably rotated between the down folded flap and the case when the rotary blade is actuated to slit the tab.

Thus, while a preferred embodiment of the invention has been described using specific terms, such description is for illustrative purposes only, and it is to be understood that changes and variations may be made without departing from the spirit or scope of the following claims.

What is claimed is:

1. A continuous motion case packing and flap closing apparatus for continuously picking up groups of articles at a pickup station and transferring the articles to an article insertion section where the articles are inserted into cases having major flaps and minor flaps maintained in a folded position adjacent sidewalls of the cases, said apparatus comprising:

a frame;

a single, central vertical axis;

a plurality of reciprocating pickup heads carried by said frame in a manner to rotate in a radial path about said central axis for picking up the articles at said pickup station and inserting the articles at said article insertion section;

a flap separation station where said major and minor flaps are separated from the sidewalls of the cases;

a rotary conveyor transporting said cases through said article insertion section, and said flap separation station;

a pickup head motion converter operatively connected to said pickup heads to move said pickup heads in a compound motion that includes a secondary rotation and a translation to effect a first generally linear path at said pick-up station for reliable article pick up and a second generally linear path at said flap separation station for reliable flap separation.

2. The apparatus of claim 1 wherein said flap separation station includes flap guides for raising the separated flaps to facilitate closure over the inserted articles.

3. The apparatus of claim 2 wherein said pickup heads have an article release position, and said pickup heads being placed in said release position after said flaps have been raised so that the flaps may be closed.

4. The apparatus of claim 3 wherein said radial transport path of said rotary conveyor and said radial path of said pickup head are parallel and coincident.

5. The apparatus of claim 3 wherein said first tab slitting mechanism is located upstream of said case packing station so that said first tab-lock is severed without said articles deposited in said case.

6. A case packing and case flap closure apparatus for picking up groups of articles at a pickup station and packing the articles into cases; said cases being transported from a case delivery section to a case exit section; and said cases having first and second minor and major flaps interconnected in folded positions adjacent end walls and sidewalls of the case by first and second tab-locks wherein said apparatus comprises:

a frame;

a plurality of reciprocating pickup heads carried by said frame for rotation in a radial path about a single vertical axis for picking up said articles at said pickup station and placing said articles in said cases;

a rotary conveyor plate rotating with said pickup heads about said single axis having a radial transport path, said conveyor adapted to receive and transport successive cases from said case delivery section to said case exit section;

a case packing and flap separation station disposed between said case delivery section and said case exit section along said radial transport path where said articles are inserted and packed into said cases and said major and minor flaps are separated from said case end walls and sidewalls for closure and sealing;

said case packing and flap separation station including a first tab slitting section for severing said first tab-lock to provide separated first minor and major flaps, and a second tab slitting section for severing said second tab-lock to provide separated second minor and major flaps; and said rotary conveyor plate transporting said cases through said case packing and flap separation station along said radial transport path;

whereby cases are continuously packed with articles, tab-lock severed, and case flaps are separated for closure while conveyed along said radial transport path about said single axis.

7. The apparatus of claim 6 including a pickup head actuator having a grip position where said pickup heads grip the group of articles, and a release position where the articles are released from said pickup heads, said pickup heads being maintained in said grip position with the articles inserted in the cases being transported along said radial path through at least one of said tab slitting sections.

8. The apparatus of claim 7 including a motion converter carried by said frame operatively connected to said pickup heads to cause said pickup heads in said grip position to move generally in a straight-line and thereby guide said articles and cases linearly through said at least one of said tab slitting sections.

9. The apparatus of claim 6 including a motion converter carried by said frame and operatively connected to said pickup heads causing said pickup heads to move generally in a straight-line path in parallel alignment with said articles as said pickup heads are lowered to engage and pick up said articles at the pickup station.

10. The apparatus of claim 6 including a motion converter carried by said frame and operatively connected to said pickup heads causing said pickup heads to move generally in a straight-line path in parallel alignment with said articles as said pickup heads are lowered to engage and pick up said articles.

11. The apparatus of claim 6 wherein said case packing and flap separation station is arranged along said transport path so that said articles are inserted in the cases when said first and second tab-locks are cut whereby the weight of the articles holds the cases down for reliable tab-lock cutting.

12. The apparatus of claim 6 including first and second tab slitting mechanisms carried at said first and second flap slitting sections operative to sever the first and second tab-locks during transport of said cases on said conveyor plate.

13. The apparatus of claim 12 wherein said first slitting section includes an outer guide and an inner guide arranged adjacent inner and outer edges of said rotating conveyor plate to assist the positioning and guiding said cases along a generally linear path during movement through said first slitting section.

14. The apparatus of claim 13 wherein said first slitting mechanism includes a cutting blade carried adjacent said inner guide of said first slitting section, said cutting blade being positioned to move between a first vertical sidewall of said case and a first major flap to disconnect said first major flap from a first minor flap as said case is transported through said first slitting section.

15. The apparatus of claim 14 including an upper guide plate arranged over said inner guide of said first slitting section, said upper guide plate being adapted to prevent vertical movement of said case on said rotating plate during transport through said first slitting section.

16. The apparatus of claim part 12 wherein said second flap slitting section comprises an inner guide and an outer guide arranged adjacent inner and outer edges of said rotating plate, said inner and outer guides of said second slitting section positioning and guiding said cases on said rotating plate through said second slitting section for effective tab-lock cutting.

17. The apparatus of claim 16 wherein said second slitting mechanism includes a flap separating guide and a slitter blade pivotally carried adjacent said outer guide of said second slitting section, a drive associated with said separating guide and said slitter blade, said drive being operative to pivot said separating guide into a position between a second vertical sidewall of said case and a second major flap of said case to separate said second major flap away from said second vertical sidewall, said drive being further operative to pivot said slitting blade into position to cut said second tab-lock and disconnect said second major flap from said second minor flap.

18. The apparatus of claim 17 wherein said separating guide and said slitter blade comprise a single blade member pivoted at substantially its center and extending in diverging upward directions from said center about a pivot.

19. The apparatus of claim 18 including a sensor, said sensor being operative to actuate said drive to move said slitter blade through selected positions as said case reaches selected locations within said second slitting section.

20. The apparatus of claim 6 including minor flap raising members adapted to engage and raise the first and second minor flaps after said tab-locks are severed.

21. The apparatus of claim 20 including a positioning member to further move at least one of said minor flaps to a closed position after being raised, said positioning member including a revolving horizontal plate element supported on a vertical shaft which is yieldable upon impact with a misaligned case.

22. The apparatus of claim 21 wherein said support shaft is generally rigid, and including a yieldable base securing said shaft to provide said yieldable shaft.

23. The apparatus of claim 20 including grid heads having grid fingers carried for vertical motion with said pickup heads, and wherein said minor flap raising members include engaging hooks carried by said grid heads, said grid heads positioning said engaging hooks beneath said first and second minor flaps on downward movement of said grid heads along said vertical path and during insertion of said articles into said case allowing said engaging hooks to engage beneath said separated minor flaps so that on upward movement of said grid heads along said vertical path, said hooks engage and raise said separated minor flaps.

24. The apparatus of claim 23 wherein each said engaging hook is biased in a direction toward said case, a lower end of each said engaging hook includes a cam, said cam engaging with an upper surface of said case during said downward movement of said grid head moving said hooks against said bias into a position outward of and engaging end walls of said case.

25. The apparatus of claim 20 including first and second major flap guides carried along said transport path for engaging and lifting separated first and second major flaps after the tab-locks are severed.

26. The apparatus of claim 6 wherein said first slitting section includes a first slitting mechanism for cutting said first tab-lock to separate a first major flap from said first minor flap; and said second slitting section includes a second slitting mechanism disposed downstream of said first slitting mechanism for cutting said second tab-lock to separate a second major flap from said second minor flap of said case.

27. The apparatus of claim 26 wherein said first slitting section includes an inner guide rail adjacent an inner side of said rotary conveyor plate, said second slitting section includes an outer guide rail carried adjacent an outer edge of said rotary conveyor plate, said first and second slitting sections being arranged so that said articles are inserted in the case to weigh the cases on said conveyor as said first and second tab-locks are cut.

28. The apparatus of claim 27 include an adjustable mount for mounting said pivotal arm and slitter blade so that the position of the slitter blade may be adjusted vertically.

29. The apparatus of claim 26 wherein said first slitting mechanism includes a vertically extending slitter blade carried on a horizontal pivotal arm biased in a direction to be engaged by said case transported on said conveyor entering said first slitting section so that said slitter blade is aligned for engagement between the first major flap and the sidewall of the case to sever said first tab-lock.

30. The apparatus of claim 26 wherein said second slitting mechanism includes a rotary blade, and including a sensor for sensing the position of a case entering said second slitting section to actuate said rotary blade at a proper time.

31. The apparatus of claim 30 including a pivotal trigger cam which pivots in a horizontal plane having a cam portion extending into the path of the case entering said second slitting section, said pivotal cam having a trigger portion which actuates said proximity sensor when coming into proximity therewith.

32. The apparatus of claim 31 including a rotary actuator for rotating said rotary knife, said rotary actuator being activated by said trigger portion of said cam plate coming into proximity with the sensor.

33. The apparatus of claim 30 including a blade guard disposed below a free edge of the second major flap of the case in a folded position, said blade guard overlying said rotary blade in the folded position to prevent engagement between the case and the tip end of said rotary blade as the case enters the second slitting section, and said rotary blade and guard blade being disposed below said free edge of the second major flap in the folded position.

34. The apparatus of claim 6 including a motion converter carried by said frame and operatively connected to said pickup heads to cause said pickup heads to move in a first straight-line path at said pickup station, and move in a second straight-line path at one of said first and second tab slitting sections.

35. The apparatus of claim 34 wherein said motion converter imparts a secondary rotation and a translation to said pickup heads in order to effect said straight-line paths.

36. The apparatus of claim 35 including a plurality of supports carried by said frame, said pickup heads being slidably carried on said supports whereby said pickup heads rotate on said supports when said secondary rotation is imparted.

37. A case packing and case flap closure apparatus comprising:

a single, central vertical axis;

a rotating conveyor plate continuously rotating about said central vertical axis having a radial transport path passing through a case delivery section where empty cases are delivered onto said conveyor plate; and a case exit section where packed cases are removed from said conveyor plate;

a case packing and flap separation station disposed along said radial transport path having an article insertion section where articles are inserted into the cases, and first and second flap tab-lock slitting sections where tab-locks are severed so that interconnected major and minor flaps by said tab-locks are separated from one another;

engaging members adapted to engage and elevate said first and second separated minor and major flaps within said case packing and flap separation station; and a plurality of pickup heads picking up and gripping said articles while rotating in a radial path about said central axis and said pickup heads adapted to insert said gripped articles into the transported cases at said article insertion section.

38. The packing apparatus of claim 37 including an actuator controlling said pickup heads between an article gripping position and an article release position, said actuator maintaining said pickup heads in the gripping position while the articles are inserted in the cases transported through said article insertion and said tab-slitting sections.

39. The packing apparatus of claim 38 including connector mechanisms operatively connected to said pickup heads to cause said pickup heads in the gripping position to move linearly as well as radially during passage through at least one said tab slitting section whereby said cases are guided linearly.

40. The packing apparatus according to claim 39 including flap guides carried about said radial transport path for raising said flaps after said tab-locks have been severed.

41. The apparatus of claim 37 wherein said case packing station and said tab-lock slitting sections are disposed generally at the same location along said transport path so that said inserted articles sufficiently weight said cases for effective cutting of said tab-locks.

42. The apparatus of claim 41 wherein said tab slitting section includes a first tab slitting mechanism on one side of said transport path for cutting a first tab-lock and a second tab slitting mechanism on an opposing side of said transport path for cutting a second tab-lock; and said first and second sections include flap members for lifting said major and minor flaps after tab-lock cutting to close said flaps.

43. A method for picking up articles, packing the articles into cases having side major flaps and end minor flaps secured to sidewalls and end walls of the case by tab-locks, and separating said flaps from the sidewalls and end walls of the cases to facilitate closing, said method comprising:

continuously rotating a plurality of vertically reciprocating pickup heads in a radial path about a central axis to pick up successive groups of the articles;

continuously transporting a plurality of empty indexed cases about said central axis along a radial transport path;

placing the articles in said empty cases along a section of said radial transport path to provide packed cases; and severing at least one of said tab-locks securing said major and minor flaps along a section of said radial transport path after said articles are placed in said packed cases.

44. The method of claim 43 including continuing to grip the articles in the packed cases transported along said radial transport path with said pickup heads, and severing said tab-lock while the articles are gripped.

45. The method of claim 44 including causing said pickup heads to move in a generally straight-line while rotating along said radial path to guide the packed cases linearly for severing said tab-lock.

46. The method of claim 45 including causing said pickup heads to move in a generally straight-line while picking up said successive groups of articles.

47. The method of claim 46 including causing said pickup heads to move generally in a straight-line by swiveling said pickup head in a secondary rotation and in translation while remaining ones of said plurality of pickup heads are moved only along said radial path.

48. The method of claim 45 including severing all the tab-locks while guiding said packed cases linearly using pickup heads gripping the articles and moving on said straight-line.

49. The method of claim 48 including separating the major and minor flaps from said case sidewalls and end walls, and thereafter closing the flaps over the case for sealing.

50. The method of claim 43 including causing said pickup heads to move in a generally straight-line while picking up said successive groups of articles.

51. The method of claim 43 including transporting said cases on a rotating conveyor and rotating said conveyor about said central axis, and causing successive cases to be indexed on said conveyor plate for rotation through said case deposit section and said tab slitting section.

* * * * *